US011780056B2

(12) United States Patent
Finnäs et al.

(10) Patent No.: US 11,780,056 B2
(45) Date of Patent: Oct. 10, 2023

(54) CONDUIT ARRANGEMENTS IN INTERMEDIATE PAD, BACKING PAD, AND ABRADING ARTICLE FOR EXTRACTING ABRADING DEBRIS

(71) Applicant: Mirka Ltd, Jepua (FI)

(72) Inventors: Stig Finnäs, Sundby (FI); Simon Bäck, Vörå (FI)

(73) Assignee: Mirka Ltd, Jepua (FI)

( * ) Notice: Subject to any disclaimer, the term of this patent is extended or adjusted under 35 U.S.C. 154(b) by 643 days.

(21) Appl. No.: 16/484,178

(22) PCT Filed: Feb. 13, 2017

(86) PCT No.: PCT/FI2017/050079

§ 371 (c)(1),
(2) Date: Aug. 7, 2019

(87) PCT Pub. No.: WO2018/146372

PCT Pub. Date: Aug. 16, 2018

(65) Prior Publication Data

US 2020/0023495 A1 Jan. 23, 2020

(51) Int. Cl.
*B24D 9/08* (2006.01)
*B24D 11/02* (2006.01)
(Continued)

(52) U.S. Cl.
CPC ..... *B24D 9/08* (2013.01); *B24B 55/102* (2013.01); *B24D 11/02* (2013.01); *B24D 13/14* (2013.01)

(58) Field of Classification Search
CPC ..... B24B 55/10; B24B 55/102; B24B 55/105; B24B 23/02; B24B 23/028; B24D 9/08;
(Continued)

(56) References Cited

U.S. PATENT DOCUMENTS 2,478,074 A * 8/1949 Atkin ..... B24B 55/102 451/511
4,058,936 A * 11/1977 Marton ..... B24B 55/102 451/359

(Continued)

FOREIGN PATENT DOCUMENTS

CN 2701589 Y * 5/2005
EP 1524077 A1 4/2005

(Continued)

OTHER PUBLICATIONS

"Unbroken." Merriam-Webster.com Dictionary, Merriam-Webster, https://www.merriam-webster.com/dictionary/unbroken. Accessed Mar. 22, 2022. (Year: 2022).*

(Continued)

*Primary Examiner* — Eileen P Morgan
(74) *Attorney, Agent, or Firm* — ARENTFOX SCHIFF LLP

(57) ABSTRACT

The presented solution discloses conduit arrangements in an intermediate pad (20, 100), a backing pad (10, 200) and an abrading article (300, 400). The conduit arrangements enable controlled conveyance of air onto and extraction of air and debris from the surface of an intermediate pad (20, 100), a backing pad (10, 200) and an abrading article (300, 400). The presented solution is an intermediate pad (20, 100) suitable for use in an abrading system. The presented solution is an abrading system comprising an intermediate pad (20, 100). The presented solution is a backing pad (10, 200) suitable for use in an abrading apparatus (1). The presented solution is an abrading system comprising a backing pad (10, 200). The presented solution is an abrading article (300, 400) suitable for use in an abrading system. The presented solution is an abrading system comprising an abrading article (300, 400). The presented solution further
(Continued)

relates to methods of using an abrading system for extracting abrading debris.

9 Claims, 20 Drawing Sheets

(51) Int. Cl.
*B24D 13/14* (2006.01)
*B24B 55/10* (2006.01)

(58) Field of Classification Search
CPC ..... B24D 9/10; B24D 9/085; B24D 11/02; B24D 13/14; B24D 13/142; B24D 13/147; B24D 13/18
USPC ..... 451/59, 359, 456
See application file for complete search history.

(56) References Cited

U.S. PATENT DOCUMENTS 4,287,685 A * 9/1981 Marton ..... B24B 55/102 451/514
4,839,995 A * 6/1989 Hutchins ..... B24B 23/04 451/357
5,105,585 A * 4/1992 Hampl ..... B24B 55/102 451/359
5,283,988 A * 2/1994 Brown ..... B24D 15/04 451/344
5,309,682 A 5/1994 Gutknecht et al.
5,582,541 A * 12/1996 Hutchins ..... B24B 23/03 451/344
6,007,415 A 12/1999 Van Osenbruggen
7,377,837 B2 * 5/2008 Piliguian ..... B24B 55/102 451/6
9,975,219 B2 * 5/2018 Fontes Da Rocha Castro ..... B24D 9/08
10,576,610 B2 * 3/2020 Valentini ..... B24B 55/102
2010/0323594 A1 * 12/2010 Sun ..... B24B 55/102 451/360
2012/0122384 A1 * 5/2012 Goers ..... B24D 11/00 451/548
2012/0276824 A1 * 11/2012 Marton ..... B24D 9/08 51/293
2016/0158920 A1 * 6/2016 Valentini ..... B24B 55/102 451/490
2020/0353593 A1 * 11/2020 Finnäs ..... B24B 55/105
2020/0361051 A1 * 11/2020 Finnäs ..... F16C 37/007

FOREIGN PATENT DOCUMENTS

EP 2145733 A1 * 1/2010 ..... B24B 55/102
EP 3028811 A1 6/2016
GB 1532774 A * 11/1978 ..... B24B 55/102
JP S526195 A 1/1977
JP 07237131 A 9/1995
KR 200433114 Y1 * 12/2006
TW M329497 U 4/2008
TW M331408 U 5/2008
TW 201532730 A 9/2015
WO 2007031815 A1 3/2007
WO 2014083243 A1 6/2014

OTHER PUBLICATIONS

Taiwan Patent Office, Search Report dated Sep. 27, 2021 issued in Taiwanese counterpart Application No. 107102225.
Office Action in TW111135842, dated Jul. 11, 2023, 14 pages.

* cited by examiner

CONDUIT ARRANGEMENTS IN INTERMEDIATE PAD, BACKING PAD, AND ABRADING ARTICLE FOR EXTRACTING ABRADING DEBRIS

PRIORITY

This application is a U.S. national application of the international application number PCT/F12017/050079 filed on Feb. 13, 2017.

FIELD

The solution to be presented relates to extracting debris during abrading a work piece with an abrading apparatus.

The solution relates to an intermediate pad suitable for use in an abrading system. The solution relates to an abrading system comprising an intermediate pad. The solution relates to a backing pad suitable for use in an abrading apparatus. The solution relates to an abrading system comprising a backing pad. The solution relates to an abrading article suitable for use in an abrading system. The solution relates to an abrading system comprising an abrading article. The solution further relates to methods of using an abrading system for extracting abrading debris.

BACKGROUND

Abrading is performed in a multitude of contexts such as automobile repair and paint work, building construction and repair, and manufacturing and repairing furniture and the like. In all such contexts, abrading creates debris which should be efficiently and controllably extracted from the abrading process, because remaining debris negatively affects abrading efficiency and result, and constitutes a health hazard and a nuisance if spread out. In some abrading applications, user control, cost efficiency and/or resulting surface quality can be improved by using an intermediate pad between the abrading article and the backing pad of an abrading apparatus.

SUMMARY

The presented solution is an intermediate pad suitable for use in an abrading system. The presented solution is an abrading system comprising an intermediate pad. The presented solution is a backing pad suitable for use in an abrading apparatus. The presented solution is an abrading system comprising a backing pad. The presented solution is an abrading article suitable for use in an abrading system. The presented solution is an abrading system comprising an abrading article. The presented solution further relates to methods of using an abrading system for extracting abrading debris.

The presented solution discloses conduit arrangements in an intermediate pad, a backing pad and an abrading article. Such an intermediate pad, a backing pad and an abrading article are suitable for use in an abrading system comprising an abrading apparatus capable of producing sucking pressure or capable of being connected to a source of sucking pressure for the purposes of extracting abrading debris away from the abrading process with the suction pressure.

When the said conduit arrangements are implemented on an intermediate pad, they may be adapted for improved conveyance of abrading debris away from the intermediate pad and an abrading article.

Such an intermediate pad may be suitable for use in an abrading system comprising an abrading apparatus adapted to provide suction pressure. Such an intermediate pad may comprise an upper surface layer comprising attachment elements suitable for attaching the upper surface layer to a backing pad of an abrading apparatus, a lower surface layer comprising attachment elements suitable for attaching the lower surface layer to an abrading article, optionally a single- or multi-plied intermediate layer or layers between and attached to the upper surface layer and the lower surface layer, a lower surface facing the abrading article, an upper surface facing the backing pad, an outer side wall, at least one medial conduit which terminates with an orifice on the lower surface and is suitable for conveying air and abrading debris from the lower surface, and at least one peripheral conduit which extends from the outer side wall terminating with an orifice on the lower surface, is suitable for conveying incoming air onto the lower surface and is separated from the medial conduits by an unbroken portion of the intermediate pad.

When the said conduit arrangements are implemented on a backing pad, they may be adapted for extracting abrading debris away from the backing pad and an abrading article as well as an intermediate pad, if the abrading system comprises an intermediate pad.

Such a backing pad may be suitable for use in an abrading system comprising an abrading apparatus adapted to provide suction pressure. Such a backing pad may comprise a body comprising attachment elements suitable for attaching the body to an abrading apparatus, a lower surface layer which may be attached to the body and comprise attachment elements suitable for attaching the lower surface layer to a abrading article, a lower surface facing the abrading article, an outer side wall, at least one medial conduit which terminates with an orifice on the lower surface and is suitable for conveying air and abrading debris from the lower surface, and at least one peripheral conduit which extends from the outer side wall terminating with an orifice on the lower surface, is suitable for conveying incoming air onto the lower surface and is separated from the medial conduits by an unbroken portion of the backing pad.

When the said conduit arrangements are implemented on an abrading article, they may be adapted for extracting abrading debris away from the interface between an abrading article and an abraded workpiece and/or from the interface between an abrading article and a backing pad or an intermediate pad.

Such an abrading article may be suitable for use in an abrading system comprising an abrading apparatus adapted to provide suction pressure. Such an abrading article may comprise an upper surface layer which may comprise attachment elements suitable for attaching the upper surface layer to a backing pad of an abrading apparatus or to an intermediate pad, an upper surface facing the backing pad or the intermediate pad, a lower surface layer with a lower surface which comprises abrasive material such that the lower surface may be used for abrading a workpiece, an optional single- or multi-plied intermediate layer which may additionally be porous and/or comprise multiple plies, an outer side wall, and at least one peripheral conduit which extends from the outer side wall to the lower surface and is separated from any other possible conduits by an unbroken portion of the abrading article. Advantageously, the lower surface layer may comprise an open mesh with small openings, which mesh is coated with abrasive particles.

The disclosed conduit arrangements and related methods for extracting abrading debris provide the benefit of advantageously directing air and debris flows on the surface of the intermediate pad, backing pad and/or the abrading article so that the surface is evenly flushed, when suitably used as attached to an abrading apparatus adapted to provide suction pressure. Such advantageous directing of air comprises controllably introducing incoming air also onto the medial regions of the said surfaces so as to bring about even flushing of the said surfaces including their medial regions. According to the disclosed conduit arrangements, peripheral conduits, which are blind in that they do not convey air and/or debris into any conduit in another component in the system, may force air and/or debris to pass over the said surfaces before reaching the nearest suction pressure-connected extraction conduit.

Such forced passing over the said surfaces by air and/or debris may bring about significantly more even flushing of the said surfaces than is the case with known backing pads, intermediate pads and abrading articles. Namely, with known backing pads, intermediate pads and abrading articles, the flushing of the medial regions of the said surfaces is less complete than the flushing of the central regions and peripheral regions.

Such even flushing of the said surfaces has the benefit of eliminating or reducing the amount of abrading debris remaining in the said surfaces. This is beneficial, because debris remaining in the abrading process, i.e. in the interface between an abrading article and an intermediate pad or a backing pad and/or in the interface between an abrading article and the abraded work piece may adversely affect abrasion efficiency and resulting surface quality, and may even clog the abrading article. In addition, any debris caught between the abrading article and the component of the abrading system it is attached to, i.e. an intermediate pad or a backing pad, may progressively damage the attachment elements until eventual failure. For example, drywall plaster dust may gradually abrade the hooks of a hook-and-loop fastening system on a backing pad or an intermediate pad to the extent that the backing pad or the intermediate pad must be replaced. Such replacement increases the cost of abrading, interrupts the work for the duration of replacement and requires a stock of replacements to be kept. Furthermore, accumulated debris on the abrading article, the intermediate pad and/or the backing pad adds to the weight of the system component on which debris accumulates, resulting in an imbalanced abrading system with compromised user control, abrading efficiency and surface quality.

The disclosed intermediate pad may be used as a part of an abrading system comprising an abrading apparatus, a backing pad and the disclosed intermediate pad. For abrading a work piece, the disclosed intermediate pad may be attached to an abrading article which is preferably porous and most preferably an abrading net which comprises an open mesh with small openings, which mesh is coated with abrasive particles. The backing pad and/or the abrading article may be of the type that does not comprise conduit arrangements according to as disclosed.

The disclosed backing pad may be used as a part of an abrading system comprising an abrading apparatus and the disclosed backing pad. For abrading a work piece, the disclosed backing pad may be attached to an abrading article which is preferably porous and most preferably an abrading net which comprises an open mesh with small openings, which mesh is coated with abrasive particles. The abrading article may be of the type that does not comprise conduit arrangements according to as disclosed.

The disclosed abrading article may be used as a part of an abrading system comprising an abrading apparatus and a backing pad and optionally an intermediate pad. For abrading a work piece, the disclosed abrading article may be attached to a backing pad, or the abrading article may be attached to an intermediate pad which is attached to a backing pad. The backing pad and/or the intermediate pad may be of the type that does not comprise conduit arrangements according to as disclosed.

An abrading system comprising the disclosed intermediate pad, the disclosed backing pad or the disclosed abrading article may have applications in automobile repair and paint work, building construction and repair, and manufacturing and repairing furniture and the like.

BRIEF DESCRIPTION OF THE DRAWINGS

The figures illustrate example embodiments of the presented solution, and are not to be taken to be limiting the scope its use. The figures are not in any particular scale. Moreover, any conduits in the Figures are illustrated schematically, and therefore the precise shapes and contours of the conduits may be varied while adhering to their general principles as illustrated.

DETAILED DESCRIPTION

In all abrading, whether abrading a discrete work piece or a larger surface such as a wall or a ceiling, abrading debris is created. This debris comprises abraded material from the abraded surface as well as abrasive particles detached from an abrading article such as a sandpaper or a sanding net. In the interest of abrading productivity, a high volume of abraded material from the abraded surface and therefore a high and constant volume of abrading debris is desirable.

Figure 10A:
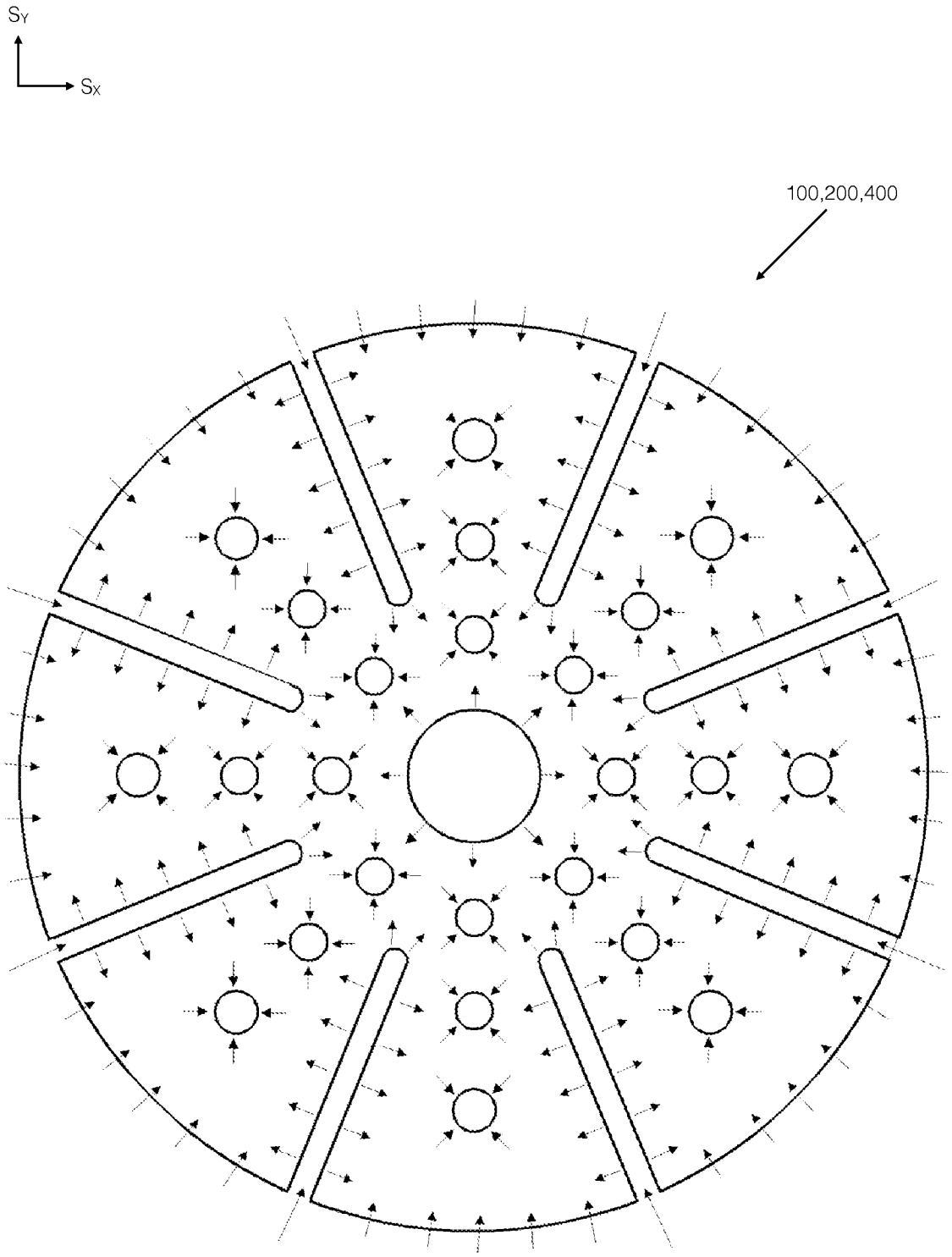
FIG. 10*a* illustrates the directions of air flows on the lower surface of an intermediate pad 100 and a backing pad 200 according to example embodiments.
Figure 10B:
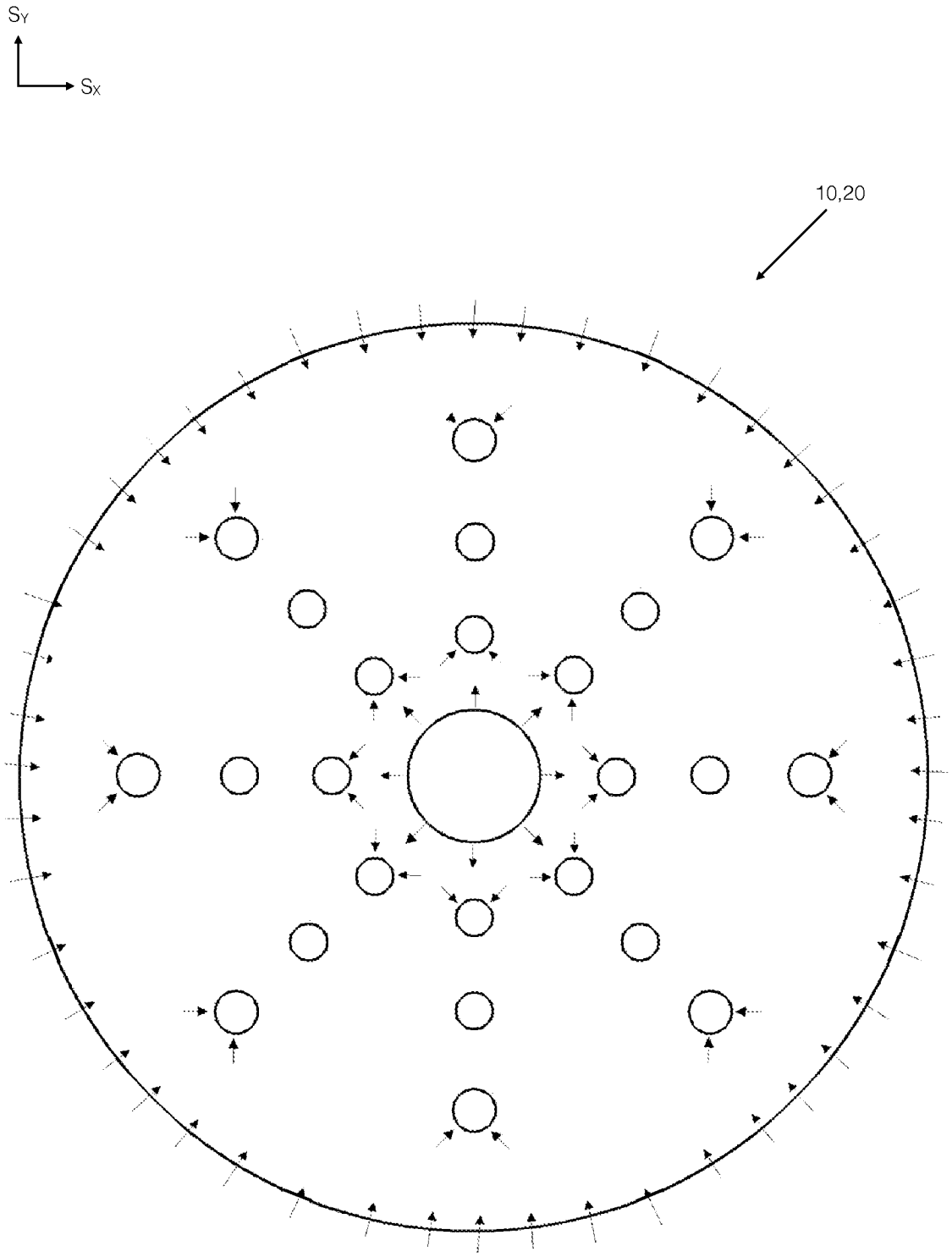
FIG. 10*b* illustrates the directions of air flows on the lower surface of an intermediate pad 20 or a backing pad 10 according to a conventional, known solution.
Figure 11A:
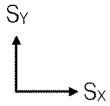
FIGS. 11*a* through 11*f* illustrate different exemplary configurations of conduits in an intermediate pad and/or a backing pad and/or an abrading article according to example embodiments, as viewed from below.
Figure 11A:
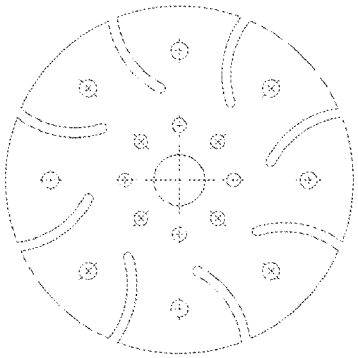
Figure 11B:
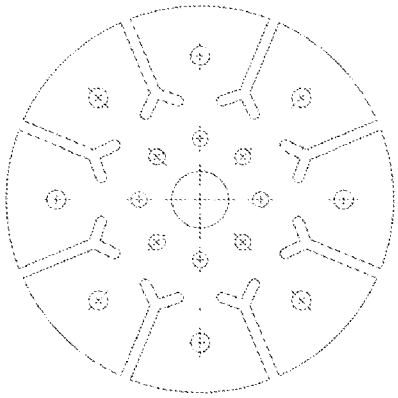
Figure 11C:
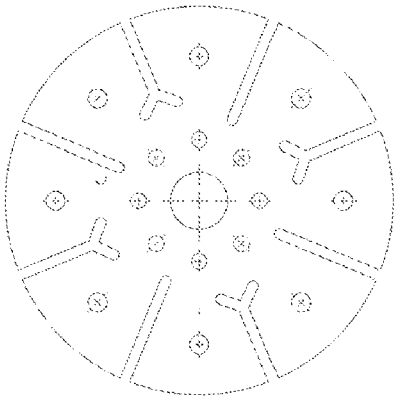
Figure 11D:
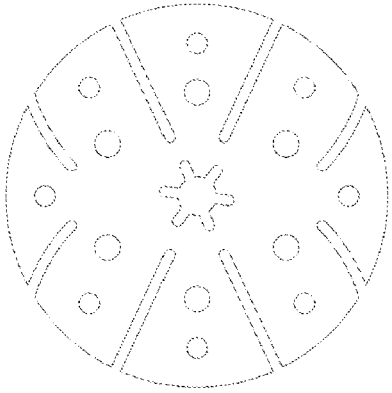
Figure 11E:
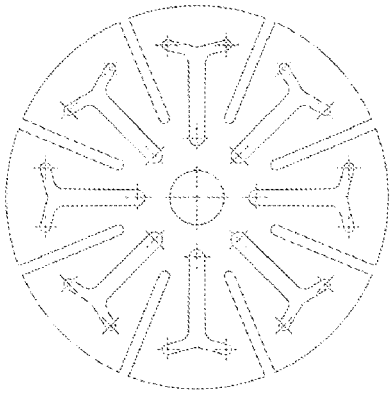
Figure 11F:
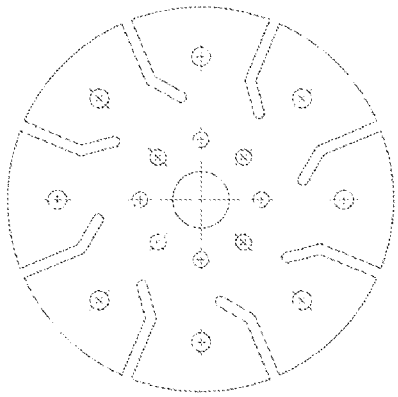

Debris extraction and conveyance is commonly brought about with a suction-based system such that there are holes on a backing pad and an abrading article through which abrading debris is sucked away from the abrading process. However, with a uniformly porous abrading article such as an abrading net, characterized by a high number of apertures distributed over the entire surface of the abrading article, debris may accumulate on a backing pad or an intermediate pad if the attachment area remains unevenly flushed. Adding more suction holes does not bring about even flushing, as illustrated in FIG. 10*b*, without controlled introduction of incoming air onto the surface to be flushed through conduits on and/or terminating with orifices on the lower surface, as illustrated in FIG. 10*a*.

The following text describes a solution to enable such even extraction of abrading debris with a novel configuration of conduits which can be implemented in a backing pad, in an intermediate pad and an abrading article. The conduit configurations may differ with respect to the precise embodiment of a backing pad, and intermediate pad and an abrading article, but they share the same guiding principles especially with respect to controllably introducing incoming air to the medial region of the product in question.

In the text, reference is made to the figures with the following numerals and denotations:

$S_X$, $S_Y$ and $S_Z$ denote orthogonal directions.

Figure 3:
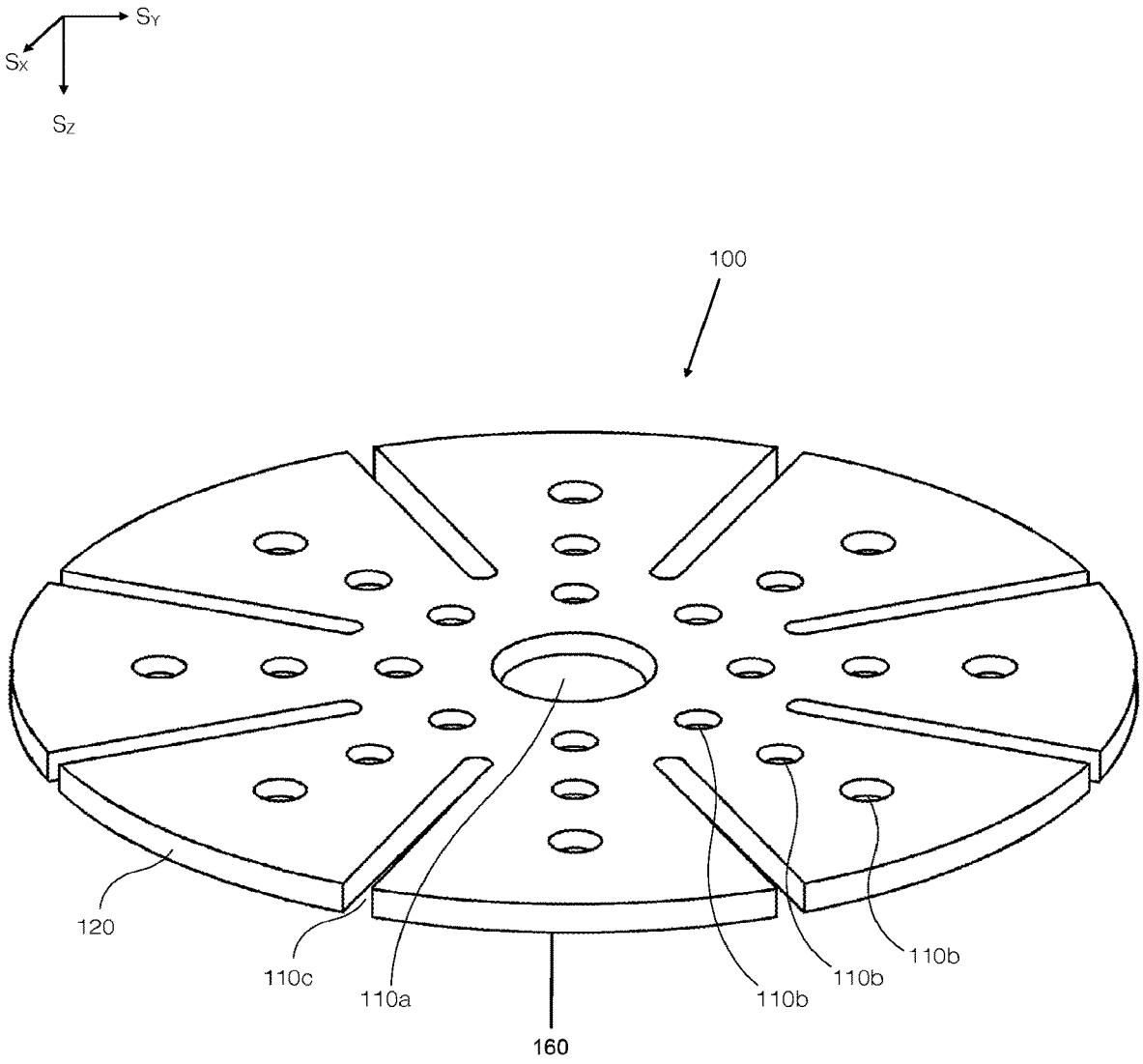
FIG. 3 illustrates an example embodiment of an intermediate pad 100.

1 Abrading apparatus
2 Conduit
3 Source of suction pressure
4 Debris collection receptacle
10 Backing pad
11*a* Central conduit
11*b* Medial conduit
12 Outer side wall
20 Intermediate pad
100 Intermediate pad
110*a* Central conduit
110*b* Medial conduit
110*c* Peripheral conduit
120 Outer side wall
130 Upper surface layer
140 Intermediate layer
150 Lower surface layer
160 Lower surface
170 Upper surface
200 Backing pad
210*a* Central conduit
210*b* Medial conduit
210*c* Peripheral conduit
220 Outer side wall
230 Body
240 Lower surface layer
250 Lower surface
260 Upper surface
300 Abrading article
310 Outer side wall
400 Abrading article
410*a* Central conduit
410*b* Medial conduit
410*c* Peripheral conduit
420 Outer side wall
430 Upper surface layer
440 Intermediate layer
450 Lower surface layer
460 Lower surface
470 Upper surface Intermediate Pad An intermediate pad 100 according to one embodiment is shown in FIG. 3. The intermediate pad 100 may have a plurality of conduits 110*a*-110*c* for desirably directing flows of air, when used as a part of an abrading system used for abrading a work piece. Such desirable flows of air, as exemplified in FIG. 10*a*, flush the surface of the intermediate pad 100 evenly for extracting abrading debris so that very little abrading debris remains on the surface of the intermediate pad 100, with the resulting benefits that the lifetime of the intermediate pad 100 is increased and the abrading process is not impaired by accumulated debris in the system. As is known, flows of air capture abrading debris and convey the captured abrading debris away from the surfaces of the intermediate pad 100 as the flows of air exit the surface of the intermediate pad 100.

Figure 4:
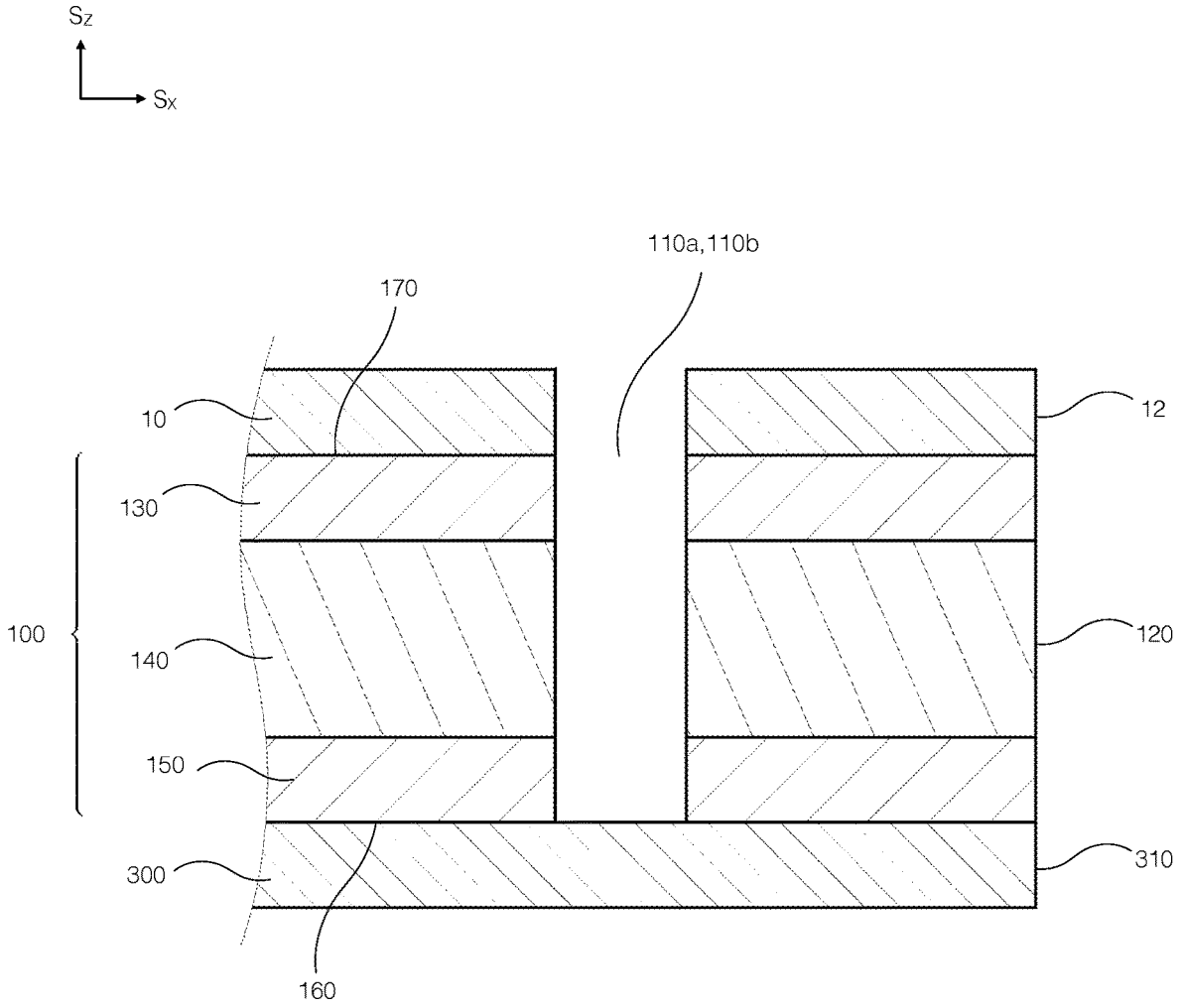
FIG. 4 illustrates a layer structure of an intermediate pad 100 as attached to a backing pad 10 and an abrading article 300.

The structure of the intermediate pad 100 according to one embodiment is illustrated in FIG. 4, as attached between a backing pad 10 and an abrading article 300.

According to the embodiment illustrated in FIG. 4, the intermediate pad 100 may comprise an upper surface layer 130, a lower surface layer 150 and an intermediate layer 140. In another embodiment, the intermediate pad 100 may comprise the upper surface layer 130 and the lower surface layer 150, and no intermediate layer. In yet another embodiment, the intermediate pad 100 may comprise the upper surface layer 130, the lower surface layer 150 and the intermediate layer 140 such that the intermediate layer 140 comprises two or more plies, which plies may be, for example, of different materials.

The intermediate pad 100 has an outer side wall 120 enclosing the upper surface layer 130, the lower surface layer 150 and the intermediate layer 140, if any. In the embodiment illustrated in FIG. 4, the outer side wall 120 has a wall surface which may be on a plane substantially perpendicular to the upper surface layer 130 and the lower surface layer 150. In other embodiments, the outer side wall 120 may be inclined such that the circumference of the intermediate pad 100 is greater at the lower surface 160 than at the upper surface 170, or vice versa.

The upper surface layer 130 may comprise attachment elements for attaching the intermediate pad 100 to a backing pad, and the lower surface layer 150 may comprise attachment elements for attaching the intermediate pad 100 to an abrading article. Such attachment elements may enable mechanical or adhesive attachment. Advantageously, such attachment enables removal and re-attachment. According to a preferred embodiment, attachment elements may comprise hook-and-loop type of fastening with the capability for convenient re-attachment. In this preferred embodiment, the upper surface layer 130 of the intermediate pad 100 may comprise hooks and the lower surface layer of the backing pad 10 may comprise loops, or vice versa, and/or the lower surface layer 150 of the intermediate pad 100 may comprise hooks and the upper surface layer of the abrading article 300 may comprise loops, or vice versa.

In another embodiment, the attachment elements may be premised on pressure sensitive adhesion, i.e. PSA. In such an embodiment, the upper surface layer 130 of the intermediate pad 100 may comprise pressure sensitive adhesive and the lower surface layer of the backing pad 10 may comprise an even surface adapted for pressure sensitive adhesion, or vice versa, and/or the lower surface layer 150 of the intermediate pad 100 may comprise pressure sensitive adhesive and the upper surface layer of the abrading article 300 may comprise an even surface adapted for pressure sensitive adhesion, or vice versa.

In the specific embodiment depicted in FIG. 4 which comprises the intermediate layer 140 and in such embodiments that comprise the intermediate layer 140 comprising multiple plies, the thickness and the material or materials of the intermediate layer 140 may be selected according to application. Examples of design choices concerning the characteristics of the intermediate layer 140 may include absorption of mechanical vibration, absorption of sound, weight, recyclability, cost, manufacturability, plasticity, and the attachability to the other layers of the intermediate pad 100. Such choices may affect the controllability of the abrading system as well as the quality of the abraded surface.

In the specific embodiment comprising the intermediate layer 140 and illustrated in FIG. 4, examples of materials which the intermediate layer 140 may comprise include soft materials such as foamed polypropylene, foamed polyethylene, foamed acryleonitrilebutadienestyrene, foamed polyurethane, foamed polyamide, foamed ethylene vinyl acetate or similar, and hard materials such as polypropylene, polyethylene, acryleonitrilebutadienestyrene, polyurethane, polyamide, aluminum or similar.

The intermediate pad 100 comprises a central region referring to the portion of the intermediate pad 100 at and near its center, a peripheral region referring to the portion of the intermediate pad 100 at and near its outer side wall 120, and a medial region referring to the portion of the intermediate pad 100 between the central and peripheral regions. The central region, the peripheral region and the medial region are defined on the $S_X$, $S_Y$ plane.

According to the embodiment illustrated in FIG. 3 in which the intermediate pad 100 has a circular shape, the central region may extend radially from the center of the intermediate pad 100 towards its outer side wall 120 to the distance of no more than 5%, or 10%, or 15%, or 20%, or 25%, or 30%, or 35% of the radius of the intermediate pad 100, and the peripheral region may extend radially from the outer side wall 120 of the intermediate pad 100 towards its center to the distance of at least 10%, or 15%, or 20%, or 25%, or 30%, or 35% of the radius of the intermediate pad 100.

In the specific embodiment depicted in FIG. 3, the central region may extend radially from the center of the intermediate pad 100 towards its outer side wall 120 to the distance of 20% of the radius of the intermediate pad 100, and the peripheral region may extend radially from the outer side wall 120 of the intermediate pad 100 towards its center to the distance 20% of the radius of the intermediate pad 100.

In other embodiments with different shapes for the intermediate pad 100 on the $S_X$, $S_Y$ plane, such as the intermediate pad 100 being rectangular or triangular, the central region, the medial region, and the peripheral region may be similarly defined by replacing the notion of a radius with the distance between the center of the intermediate pad 100 and any given point at the outer side wall 120, for example, the nearest point with respect to the center of the intermediate pad 100.

The intermediate pad 100 may comprise a plurality of conduits 110*a*-110*c* which may terminate with orifices on the lower surface 160. Such conduits may comprise a central conduit or conduits 110*a* located in or at least originating from the central region, a medial conduit or conduits 110*b* located in the medial region, and/or a peripheral conduit or conduits 110*c* originating from the peripheral region and extending into the medial region. Such conduits 110*a*-110*c* may be surrounded by an unbroken portion of the intermediate pad 100 such that no conduit 110*a*-110*c* extends into another conduit 110*a*-110*c*. The central conduit 110*a* and the peripheral conduit or conduits 110*c* may not be connected to a source of suction pressure, for example to a medial conduit or conduits 110*b*.

An unbroken portion of the intermediate pad refers to a portion of the intermediate pad 100 which contains no conduit or conduits 110*a*-110*c*, and therefore resists the flow of air to such a degree that air will flow substantially more freely along a conduit 110*a*-110*c* than through an unbroken portion of the intermediate pad 100. The purpose of conduits 110*a*-110*c* being separated from each other by unbroken portions of the intermediate pad 100 is to enable controlled conveyance of air through the conduits 110*a*-110*c* so that surface flushing can be brought about with air flowing from conduits not connected to suction pressure to conduits connected to suction pressure over the surface of the intermediate pad 100. Such controlled conveyance of air would be disturbed if the flow of air was to leak from one conduit 110*a*-110*c* directly into another.

As the peripheral conduit or conduits 110*c* may extend into the medial region of the intermediate pad 100, the peripheral conduit or conduits 110*c* may extend to the distance of more than 10%, or 15%, or 20%, or 25%, or 30%, or 35% of the distance between the starting point of the peripheral conduit 110*c* at the outer side wall 120 and the center of the intermediate pad 100 in correspondence with what was said about the extent of the peripheral region above.

The technical effect of separating the medial conduits 110*b* adapted to be connected to suction pressure in an abrading system from conduits 110*a*,110*c* not adapted to be connected to suction pressure in the abrading system is to enable controlling the flow of air from ambient pressure to low, i.e. suction pressure in order to bring about even flow of air over and across the surface of the intermediate pad 100. In the embodiment illustrated in FIG. 3, the medial conduits 110*b* may be adapted to be connected to suction pressure in an abrading system, and the central conduit 110*a* and the peripheral conduits 110*c* may not be adapted to be connected to suction pressure.

The peripheral conduits 110*c* may pass through the outer side wall 120 of the intermediate pad 100. The peripheral conduits 110*c* may be elongated such that the peripheral conduits 110*c* may extend from the peripheral region of the intermediate pad 100 to its medial region such that the end of the peripheral conduit 110*c* which is nearest to the center of the intermediate pad 100 is nearer to the center of the intermediate pad 100 than the medial conduit 110*b* which is most distant from the center of the intermediate pad 100. The peripheral conduits 110*c* may extend in the direction of or towards the central conduit 110*a* and/or the central region.

Figure 1:
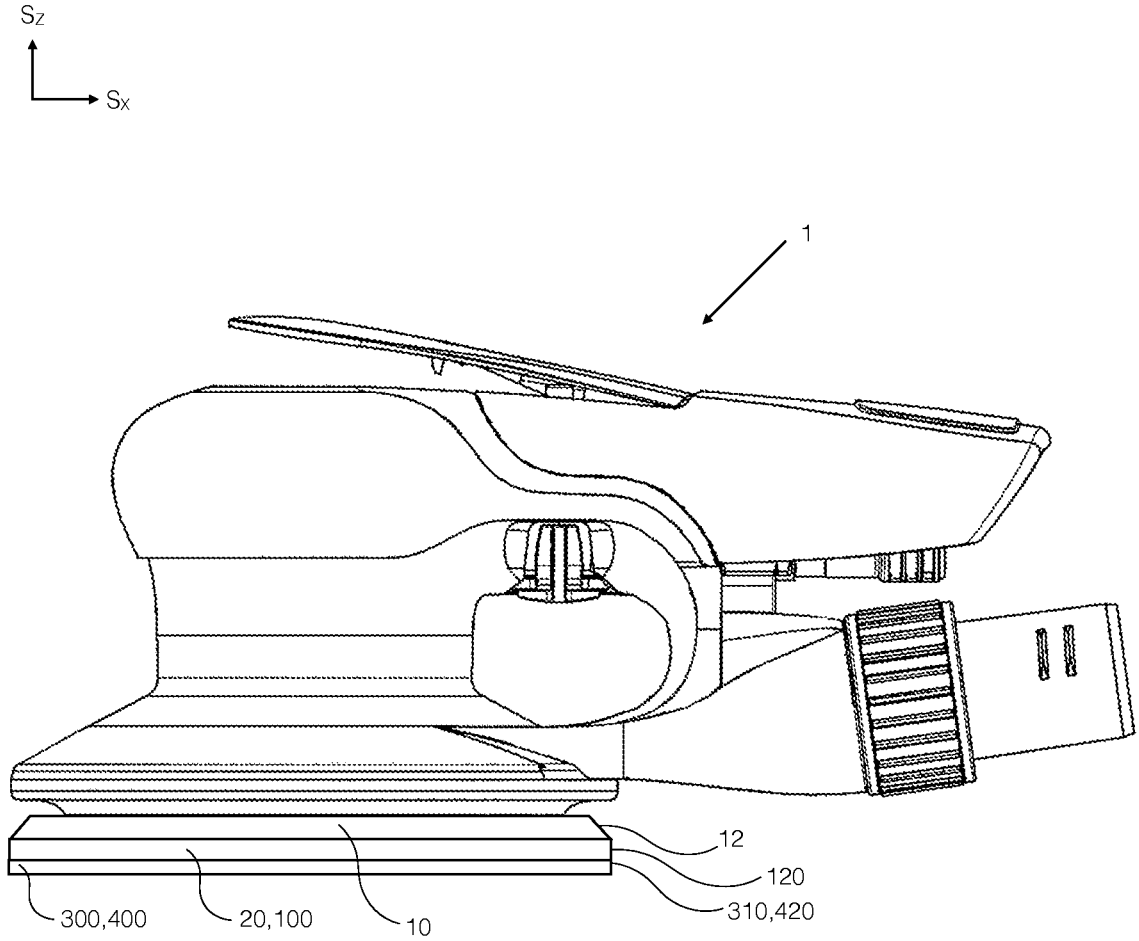
FIG. 1 illustrates an abrading apparatus 1, equipped with a backing pad 10, an intermediate pad 20, 100 and an abrading article 300, 400.
Figure 2:
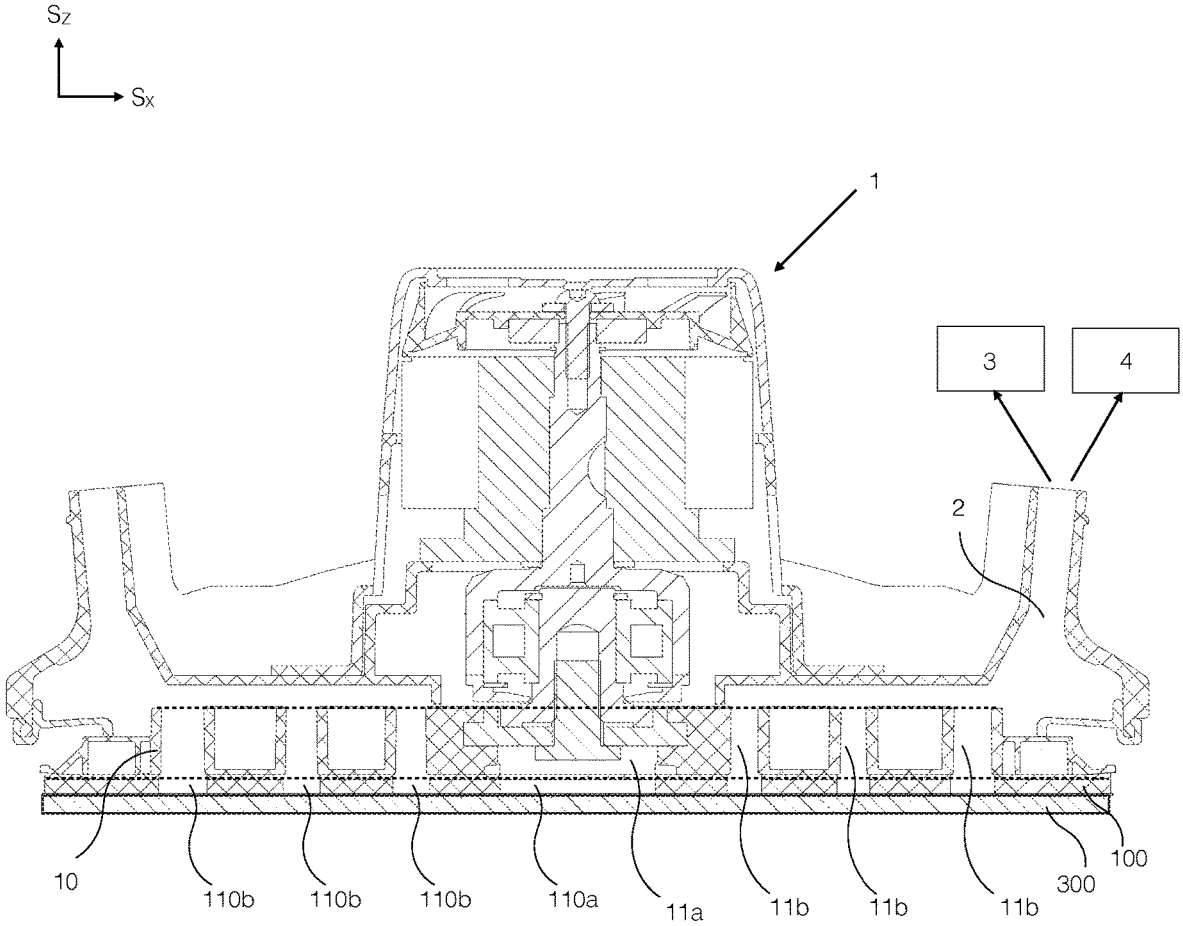
FIG. 2 illustrates a cross section view of an abrading apparatus 1 with conduits 2, and the apparatus 1 equipped with a backing pad 10, an intermediate pad 100 and an abrading article 300.

If suitably used as a part of an abrading system, as illustrated in FIGS. 1 and 2, the central and peripheral conduits 110*a* and 110*c* may be used for introducing incoming air onto the lower surface 160 of the intermediate pad 100, and the medial conduits 110*b* may be used for conveying air and debris away from the said surface.

FIG. 3 illustrates the configuration of the conduits 110*a*-110*c* according to a specific embodiment. In this embodiment there is at least one central conduit 110*a* located in the central region; a plurality of medial conduits 110*b* located in the medial region such that the medial conduits 110*b* are arranged along three concentric circles which are concentric with the center of the intermediate pad 100 with each concentric circle having several medial conduits 110*b*, for example eight medial conduits 110*b*, preferably with equal mutual distances; and several peripheral conduits 110*c*, for example eight peripheral conduits 110*c*, preferably with equal mutual distances, which peripheral conduits 110*c* pass through the outer side wall 120 of the intermediate pad 100. The central conduits 110*a* and/or the medial conduits 110*b* may be circular on the lower surface 160 of the intermediate pad 100.

The peripheral conduits 110*c* may be elongated such that the peripheral conduits 110*c* extend towards the center of the intermediate pad 100 and into its the medial region so that the ends of the peripheral conduits 110*c* extend towards the center of the intermediate pad 100 to the distance of more than half of the radius of the intermediate pad 100.

FIGS. 11*a* through 11*f* illustrate examples of different conduit configurations which may be used in other embodiments of the intermediate pad 100, or from which specific conduit geometries may be adopted into the intermediate pad 100 provided with the conduits 110*a*-110*c*. According to an example configuration illustrated in FIG. 11*a*, there may be a plurality of elongated peripheral conduits having a curvature. According to an example illustrated in FIG. 11*b*, there may be a plurality of elongated peripheral conduits with branching. According to an example illustrated in FIG. 11*c*, there may be more than one type of elongated peripheral conduits such that there may be a plurality of branching peripheral conduits and a plurality of non-branching peripheral conduits. According to an example illustrated in FIG. 11*d*, there may be a branching central conduit, and there may be a plurality of elongated peripheral conduits such that some of the elongated peripheral conduits extend from the peripheral region of the intermediate pad 100 to its medial region in a direction other than towards the center of the intermediate pad 100. According to an example illustrated in FIG. 11*e*, there may be a plurality of elongated medial conduits with branching. According an example illustrated in FIG. 11*f*, there may be a plurality of elongated peripheral conduits with an angle. While FIGS. 11*a* through 11*f* illustrate examples of different conduit configurations on the circular intermediate pad 100, the illustrated geometrical principles may be implemented on the intermediate pad 100 with a different shape, such as rectangular or triangular, as well.

In the specific embodiment illustrated in FIG. 3, the conduits 110*a*-110*c* may extend through the entire thickness of the intermediate pad 100 on the $S_Z$ axis. That is, in this embodiment, the conduits 110*a*-110*c* may extend from the upper surface 170 of the intermediate pad 100 to its lower surface 160.

Figure 5A:
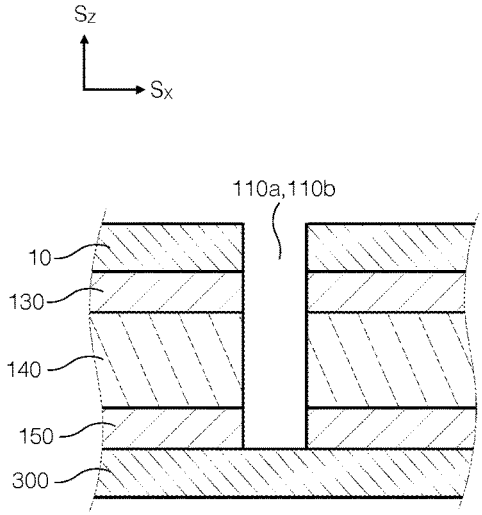
FIGS. 5*a* through 5*f* illustrate different exemplary types of conduits 110*a-c* in an intermediate pad 100 depicted in partial cross section as attached to a backing pad 10 and an abrading article 300.

In the embodiment premised on what is illustrated in FIG. 3 and FIG. 4, the conduits 110*a*-110*c* may extend from the upper surface 170 of the intermediate pad 100, through its upper surface layer 130, intermediate layer 140 and lower surface layer 150, and finally to the lower surface 160 of the intermediate pad 100. In this embodiment, the central conduit 110*a* and the medial conduits 110*b* are of the type illustrated in FIG. 5*a*, i.e. a hole which extends through the entire thickness of the intermediate pad 100, and the peripheral conduit 110*c* is of the type illustrated in FIG. 5*f*, i.e. a slit which extends through the entire thickness of the intermediate pad 100 and as shown in FIG. 3 and FIGS. 11*a* through 11*f*.

FIGS. 5*b*, 5*c*, 5*d* and 5*e* illustrate conduit types which may be employed in other embodiments of the intermediate pad 100 premised on the layer structure illustrated in FIG. 4, i.e. in such embodiments which comprise the intermediate layer 140. Conduit types illustrated in FIGS. 5*a* and 5*f* may be employed in embodiments of the intermediate pad 100 with or without the intermediate layer 140.

Figure 5B:
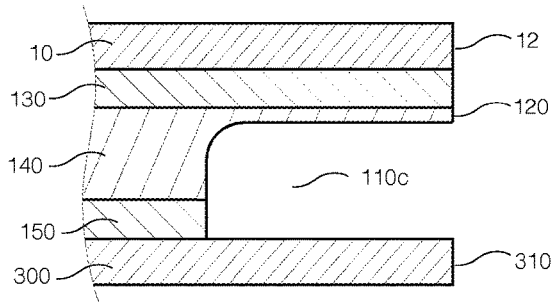
Figure 5C:
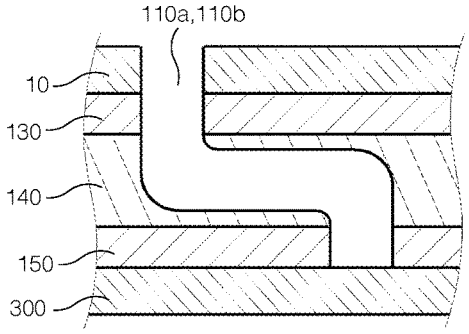

FIG. 5*b* illustrates an example of the peripheral conduit 110*c* which originates from and passes through the outer side wall 120 of the intermediate pad 100, and is elongated on the $S_X$, $S_Y$ plane, has an equally elongated orifice on the lower surface 160 of the intermediate pad 100, and extends on the $S_Z$ axis through the lower surface layer 150, partially through the intermediate layer 140 and not into the upper surface layer 130. This conduit type is for example a groove on the lower surface 160 of the intermediate pad 100, the groove being open towards the abrading article 300. Preferably, the groove has an open end at the outer side wall 120 and at least one opposite, closed end. This conduit type may be modified so that it extends on the $S_Z$ axis through the intermediate layer 140 entirely instead of partially, in which case this conduit type may be used in embodiments of the intermediate pad 100 which may not comprise the intermediate layer 140.

Figure 5D:
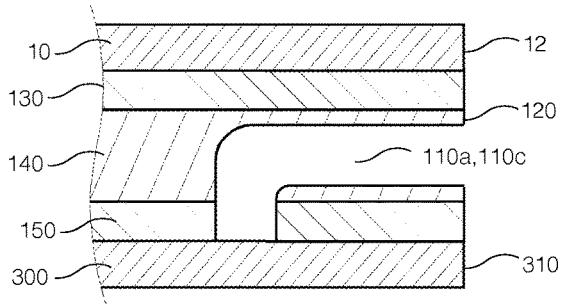

FIG. 5*d* illustrates an example of the peripheral conduit 110*c* and/or the central conduit 110*a*, which originates from and passes through the outer side wall 120 of the intermediate pad 100, travels within the intermediate layer 140 and may be configured puncture the lower surface 160 in a desired location, including the center of the intermediate pad 100. This may enable freedom of choice over the location on the lower surface 160 of the intermediate pad 100 to which incoming air is conveyed, including an advantageous use of the intermediate pad 100 with the backing pad 10 and/or an abrading apparatus with no central air conduit. This conduit type used as the peripheral conduit 110*c* comprises for example a groove on the lower surface 160, the groove being open towards the abrading article 300. In such a case, the peripheral conduit 110*c* preferably comprises the groove with at least two closed ends and an orifice on the outer side wall 120. In other words, in this preferable case the peripheral conduit 110*c* has an elongated orifice on the lower surface 160. This conduit type may be modified so that it extends on the $S_Z$ axis through the intermediate layer 140 entirely instead of partially.

Figure 5E:
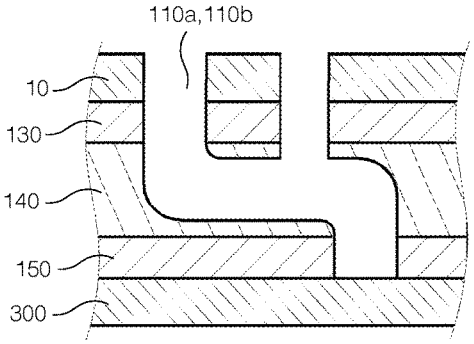
Figure 5F:
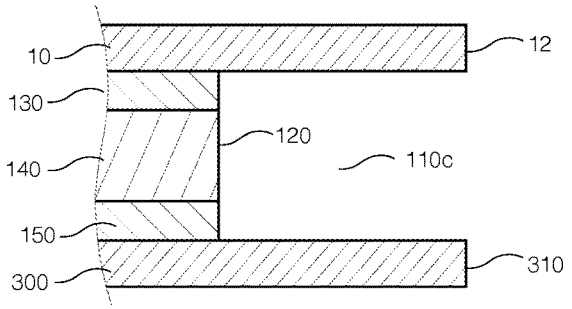

FIGS. 5*c* and 5*e* illustrate the central conduit 110*a* and/or the medial conduit 110*b* with orifices transversally offset on the $S_X$, $S_Y$ plane in the upper surface layer 130 and the lower surface layer 150. This enables advantageous configuring of conduits on the lower surface 160 of the intermediate pad 100 differently from the conduit configuration on the upper surface 170 and in the backing pad 10. This conduit type may be modified so that it extends on the $S_Z$ axis through the intermediate layer 140 entirely instead of partially.

In the intermediate pad 100, each group of conduits, i.e. the central conduits 110*a*, the medial conduits 110*b*, and/or peripheral conduits 110*c*, may employ a different type of conduit as explained above. Furthermore, each said group of conduits may employ different types of conduits within that group such that more than one of the conduit types explained above and illustrated in FIG. 5*a* to FIG. 5*f* may be used within a group of conduits.

In the intermediate pad 100, each group of conduits, i.e. the central conduits 110*a*, the medial conduits 110*b*, and/or peripheral conduits 110*c*, may use conduit type different from another group of conduit.

The intermediate pad 100 according to the specific embodiment illustrated in FIG. 3 and FIG. 4, i.e. the embodiment comprising the intermediate layer 140 and the conduits 110*a*-110*c* which extend from the upper surface 170 to the lower surface 160, may be manufactured for example by punching. Such punching may be carried out with suitable punches and dies, a sheet comprising the upper surface layer 130, the intermediate layer 140 and the lower surface layer 150. Such layers may be attached to each other adhesively prior to punching. Alternatively, such layers may be punched separately and attached to each other after punching, for example adhesively.

The intermediate pad 100 without the intermediate layer 140 but otherwise in accordance to the said specific embodiment illustrated in FIGS. 3 and 4 may be similarly manufactured by punching. Such punching may be carried out with suitable punches and dies, a sheet comprising the upper surface layer 130 and the lower surface layer 150. Such layers may be attached to each other adhesively prior to punching. Alternatively, such layers may be punched separately and attached to each other after punching, for example adhesively.

Embodiments of the intermediate pad 100 comprising conduits of the types illustrated in FIGS. 5*b*, 5*c*, 5*d* and/or 5*e* may be manufactured for example by manufacturing additively, such as with three-dimensional printing, the intermediate layer 140, punching the upper surface layer 130 and the lower surface layer 150 out of a sheet of suitable material, and finally attaching the all the layers 140, 130 and 150 to each other adhesively.

The intermediate pad 100 as explained above may be used in an abrading system comprising an abrading apparatus 1 and the backing pad 10 and the intermediate pad 100, as illustrated in FIG. 1 according to one embodiment. The intermediate pad 100 may be of the type comprising the intermediate layer 140 as explained above, or of the type not comprising the intermediate layer 140 as also explained above. During abrading a work piece with such an abrading system, the abrading article 300 may be attached to the intermediate pad 100. The abrading article 300 is preferably porous and most preferably an abrading net which comprises an open mesh, which mesh is coated with abrasive particles and comprises a plurality of openings. During abrading, the abrading apparatus 1 may rotate and/or oscillate the backing pad 10. Such rotation and/or oscillation may be brought about by a source of power of the abrading apparatus 1 such as an electric or a pneumatic motor.

The abrading article 300, the backing pad 10 and the intermediate pad 100 may be of any shape on the $S_X$, $S_Y$ plane, such as rectangular, triangular, or preferably round if rotating. Advantageously, the backing pad 10, the intermediate pad 100 and the abrading article 300 are substantially of the same shape. The backing pad 10 and the abrading article 300 may be, for example, of conventional, known type, or they may incorporate the principles of the solution disclosed for the backing pad 200 and the abrading article 400.

An embodiment of the abrading system is illustrated in cross section in FIG. 2, wherein the intermediate pad 100 is in accordance with the specific embodiment shown in FIG. 3. In this embodiment of the abrading system, the central and medial conduits 110*a* and 110*b* of the intermediate pad 100 are respectively aligned with the central and medial conduits 11*a* and 11*b* of the backing pad 10. Furthermore, the medial conduits 11*b* of the backing pad 10 are aligned with the conduits 2 of the abrading apparatus 1. The conduits 2 of the abrading apparatus 1 may be connected to, or are adapted to be connected to, a source of suction pressure 3 which may comprise a debris collection receptacle 4.

It is to be generally understood that for conduits to be aligned, the conduits do not necessarily have to be geometrically perfectly aligned such that, for example, their orifices would perfectly match each other without any geometrical offset or difference in area, or that the conduits would need to be hermetically coupled to each other. Instead, conduits are to be understood to be aligned when they constitute a functional air and/or debris conveyance pathway, i.e. it is possible to convey air and/or debris from one conduit into another.

During operation of the abrading system, the central conduit 11*a* of the backing pad 10 may convey incoming air through the central conduit 110*a* of the intermediate pad 100 onto the lower surface 160 of the intermediate pad 100. The peripheral conduits 110*c* (not visible in the cross section in FIG. 2), extending on the $S_X$, $S_Y$ plane from the medial region of the intermediate pad 100 to its peripheral region and through its outer side wall 120 may be blind in that on the backing pad 10 there are no corresponding apertures or conduits aligned with the peripheral conduits 110*c*. Thus, the peripheral conduits 110*c* are not connected to suction pressure.

According to the embodiment illustrated in FIG. 2, during abrading, abrading debris may be extracted from the lower surface 160 of the intermediate pad 100, that is from the space between the intermediate pad 100 and the abrading article 300 housing their attachment elements, with suction pressure led through the medial conduits 110*b* of the intermediate pad 100, then through the medial conduits 11*b* of the backing pad 10 into the conduits 2 of the abrading apparatus 1. The extracted abrading debris may be conveyed into a debris collection receptacle 4. Replacement air, pulled in by suction pressure onto the lower surface 160 of the intermediate pad 100, may originate through the central conduit 110*a*, the peripheral conduits 110*c* and over the outer side wall 120 of the intermediate pad 100. As the peripheral conduits 110*c* may be blind, as explained above, incoming air through these conduits may be forced to pass over the lower surface 160 of the intermediate pad 100 before reaching the nearest suction pressure-connected medial conduit 110*b*, thereby providing surface flushing which extends substantially into the medial regions of the intermediate pad 100. FIG. 10*a* illustrates the flow of air on the lower surface 160 of the intermediate pad 100 according to this embodiment.

Furthermore, if the abrading article 300 is porous such an abrading net which comprises an open mesh, which mesh is coated with abrasive particles and comprises a plurality of openings, during abrading, abrading debris may move from the abrading article 300 onto the lower surface 160 of the intermediate pad 100, and the lower surface of the abrading article 300 may be flushed in a similar manner as the lower surface 160 of the intermediate pad 100.

In other embodiments of the intermediate pad 100, the conduits 110*a*-110*c* may be differently configured on the $S_X$, $S_Y$ plane, such as according to the examples illustrated in FIGS. 11*a* through 11*f*. Additional conduit configurations may be designed for example by combining conduit types illustrated in FIGS. 11*a* through 11*f*. Different such configurations may be designed to manage the incoming and outgoing airflows in different applications, including different shapes of the backing pad 10, the intermediate pad 100 and the abrading article 300, such that the lower surface 160 of the intermediate pad 100 may be evenly flushed with air in order to extract abrading debris evenly over the whole surface of the intermediate pad 100, as illustrated according to one embodiment in FIG. 10*a*.

In yet other embodiments of the intermediate pad 100, the central conduit or conduits 110*a* may be connected to suction pressure and thereby function as air and debris extraction conduits, instead of conveying incoming air onto the lower surface 160 of the intermediate pad 100. In such embodiments, the central conduit or conduits 110*a* may therefore function similarly to the medial conduits 110*b* according to what has been described above. Such embodiments may otherwise adhere to the principles of the solution as described above. Thus, in such embodiments incoming air may originate through the peripheral conduits 110*c* and over the outer side wall 120 of the intermediate pad 100 and be forced to pass over the lower surface 160 of the intermediate pad 100 before reaching the nearest suction pressure-connected central or medial conduit 110*b*, 110*a* thereby providing surface flushing which extends substantially into the medial and central regions of the intermediate pad 100.

Backing Pad

Figure 7:
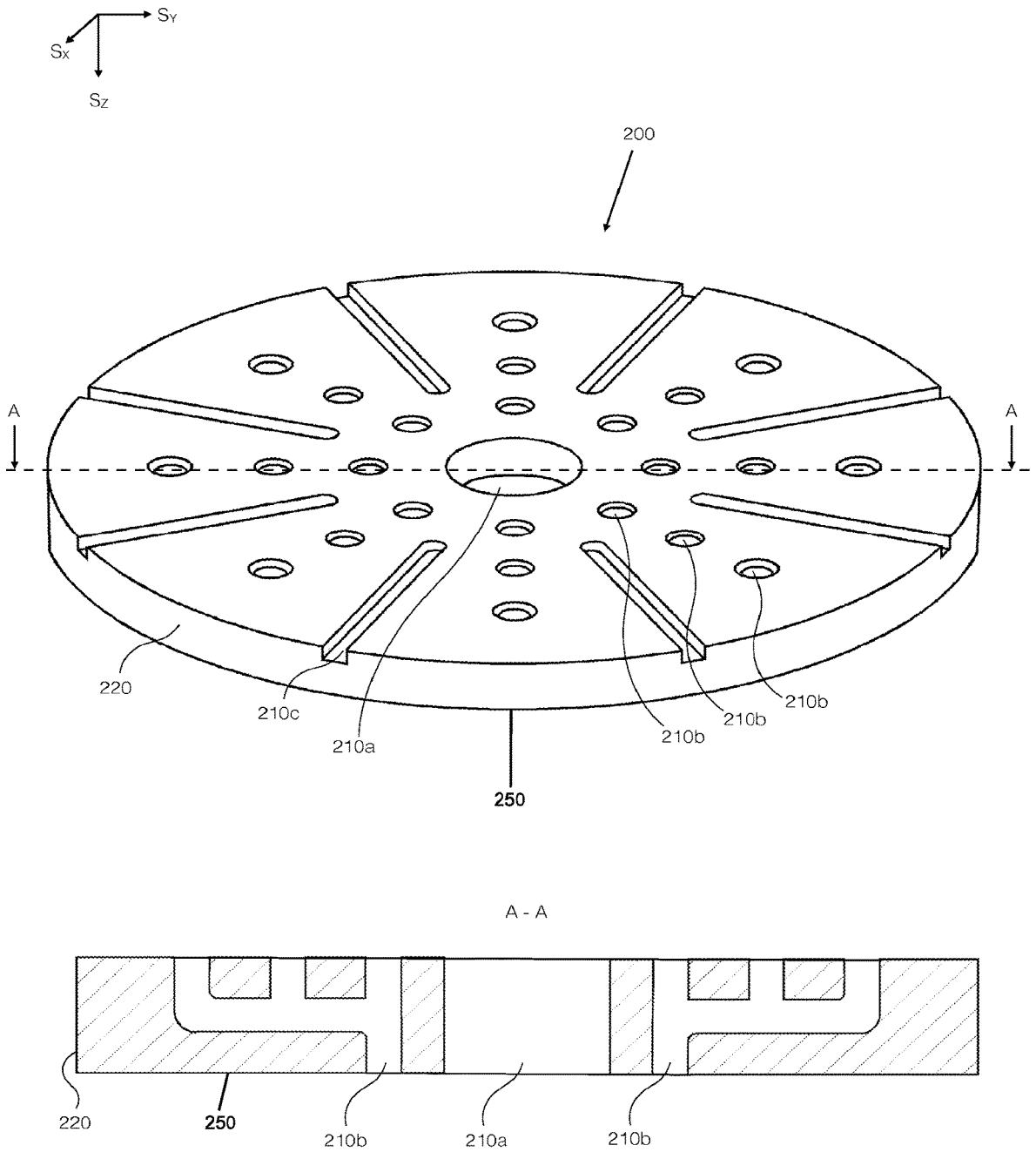
FIG. 7 illustrates an example embodiment of a backing pad 200 as viewed from below, plus a cross-sectional view.

A backing pad 200 according to one embodiment is shown in FIG. 7. The backing pad 200 may have a plurality of conduits 210*a*-210*c* for desirably directing flows of air and abrading debris, when used as a part of an abrading system used for abrading a work piece. Such desirable flows of air and abrading debris flush the surface of the backing pad 200 evenly so that very little abrading debris remains on the surface of the backing pad 200, with the resulting benefits that the lifetime of the backing pad 200 is increased and the abrading process is not impaired by accumulated debris in the system. As is known, flows of air capture abrading debris and convey the captured abrading debris away from the surfaces of the backing pad 200 as the flows of air exit the surface of the backing pad 200.

Figure 8:
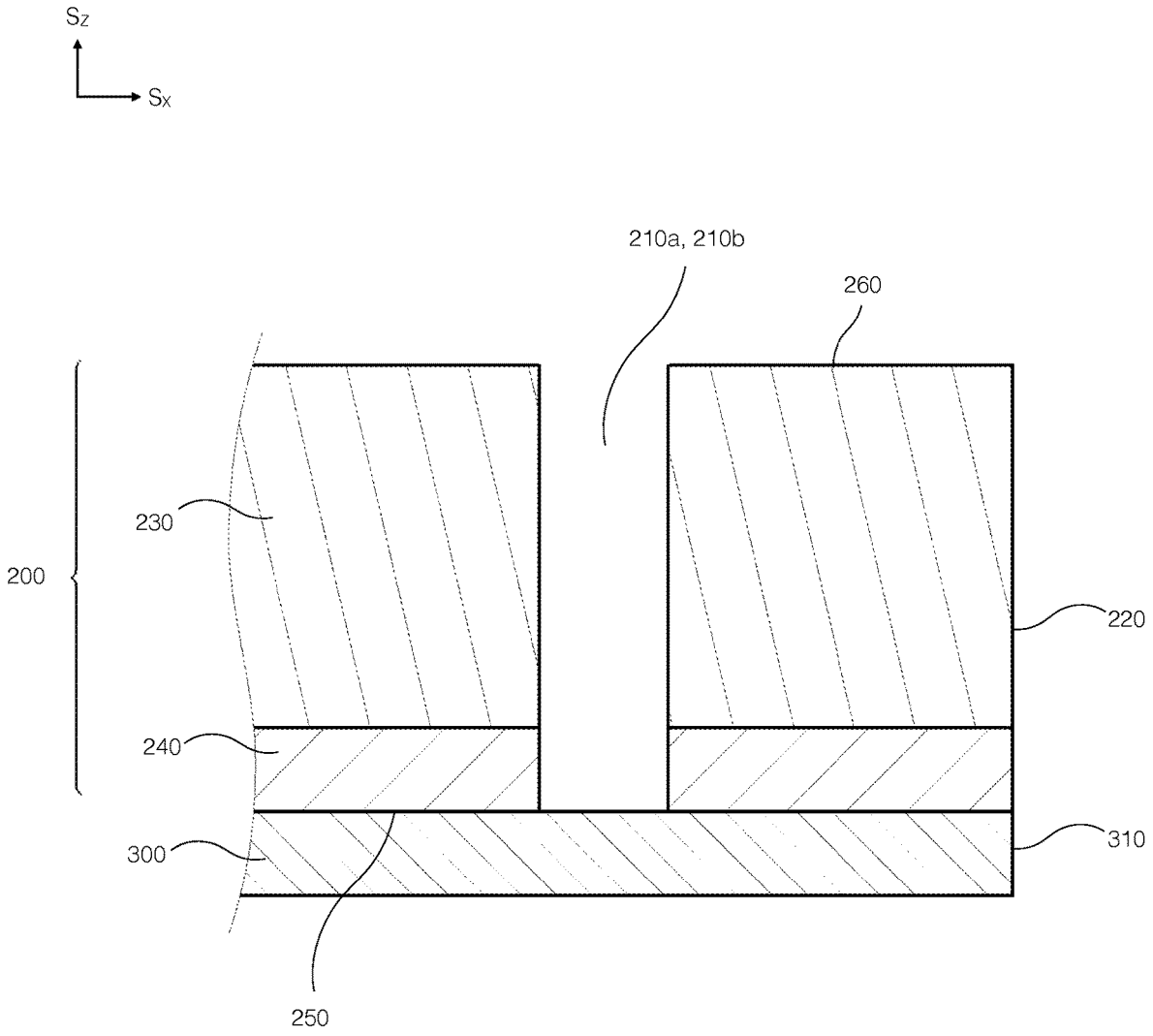
FIG. 8 illustrates a layer structure of a backing pad 200 as attached to an abrading article 300.

The structure of the backing pad 200 according to one embodiment is illustrated in FIG. 8, as attached to the abrading article 300.

According to the embodiment illustrated in FIG. 8, the backing pad 200 may comprise a body 230, a lower surface layer 240 and a lower surface 250. In another embodiment, the backing pad 200 may comprise the lower surface layer 240 and the body 230, which body 230 may comprise two or more plies, which plies may be, for example, of different materials.

The backing pad 200 has an outer side wall 220 enclosing the body 230 and the lower surface layer 240. In the specific embodiment illustrated in FIG. 8, the outer side wall 220 has a wall surface on a plane substantially perpendicular to the body 230 and the lower surface layer 240. In other embodiments, the outer side wall 220 may be inclined such that the circumference of the backing pad 220 is greater at the lower surface 250 than at the top of the body 220, or vice versa.

The lower surface layer 240 may comprise attachment elements to attach the backing pad 200 to the abrading article 300. Such attachment elements may enable mechanical or adhesive attachment. Advantageously, such attachment enables removal and re-attachment. According to a preferred embodiment, attachment elements may comprise hook-and-loop type of fastening with the capability for convenient reattachment. In this preferred embodiment, the lower surface layer 240 of the backing pad 200 may comprise hooks and the upper surface of the abrading article 300 may comprise loops, or vice versa.

In another embodiment, attachment elements may be premised on pressure sensitive adhesion, i.e. PSA. In such an embodiment, the upper surface of the abrading article 300 may comprise pressure sensitive adhesive and the lower surface layer 240 of the backing pad 200 may comprise an even surface adapted for pressure sensitive adhesion, or vice versa.

The body 230 of the backing pad may comprise attachment elements to attach the backing pad 200 to the abrading apparatus 1. Such attachment elements may enable mechanical attachment and may advantageously enable removal and re-attachment. Such attachment elements may comprise, as is known, for example, a bolt or bolts, a nut or nuts and/or a screw or screws, with the abrading apparatus 1 having suitable elements for being attached to the attachment elements of the body 230.

In the specific embodiment depicted in FIG. 8 in which the backing pad 200 comprises, in addition to the lower surface layer 240, the body 230, the thickness and the material or materials of the body 230 may be selected according to application. The same applies to embodiments of the backing pad 200 in which the body 230 comprises multiple plies.

Examples of design choices concerning the characteristics of the body 230 may include absorption of mechanical vibration, absorption of sound, weight, recyclability, cost, manufacturability, plasticity, and the attachability to the lower surface layer 240. Such choices may affect the controllability of the abrading system as well as the quality of the abraded surface.

In the specific embodiment illustrated in FIG. 8, examples of materials which the body 230 may comprise include soft materials such as foamed polypropylene, foamed polyethylene, foamed acryleonitrilebutadienstyrene, foamed polyurethane, foamed polyamide, foamed ethylene vinyl acetate or similar, and hard materials such as polypropylene, polyethylene, acryleonitrilebutadienstyrene, polyurethane, polyamide, aluminum or similar.

The backing pad 200 comprises a central region referring to the portion of the backing pad 200 at and near its center, a peripheral region referring to the portion of the backing pad 200 at and near its outer side wall 220, and a medial region referring to the portion of the backing pad 200 between the central and peripheral regions. The central region, the peripheral region and the medial region are defined on the $S_X$, $S_Y$ plane.

According to an embodiment illustrated in FIG. 7 in which the backing pad 200 has a circular shape, the central region may extend radially from the center of the backing pad 200 towards its outer side wall 220 to the distance of no more than 5%, or 10%, or 15%, or 20%, or 25%, or 30%, or 35% of the radius of the backing pad 200, and the peripheral region may extend radially from the outer side wall 220 of the backing pad 200 towards its center to the distance of at least 10%, or 15%, or 20%, or 25%, or 30%, or 35% of the radius of the backing pad 200.

In the specific embodiment depicted in FIG. 7, the central region may extend radially from the center of the backing pad 200 towards its outer side wall 220 to the distance of 20% of the radius of the backing pad 200, and the peripheral region may extend radially from the outer side wall 220 of the backing pad 200 towards its center to the distance 20% of the radius of the backing pad 200.

In other embodiments with different shapes for the backing pad 200 on the $S_X$, $S_Y$ plane, such as the backing pad 200 being rectangular or triangular, the central region, the medial region, and the peripheral region may be similarly defined by replacing the notion of a radius with the distance between the center of the backing pad 200 and any given point at the outer side wall 220, for example, the nearest point with respect to the center of the backing pad 200.

The backing pad 200 may comprise a plurality of conduits 210*a*-210*c* which may terminate with orifices on the lower surface 250. Such conduits may comprise at least a central conduit 210*a* located in or at least originating from the central region, a medial conduit or conduits 210*b* located in the medial region, and/or a peripheral conduit or conduits 210*c* originating from the peripheral region and extending into the medial region. Such conduits 210*a*-210*c* may be surrounded by an unbroken portion of the backing pad 200 such that no conduit 210*a*-210*c* extends into another conduit 210*a*-210*c*. The central conduit 210*a* and the peripheral conduit or conduits 210*c* may not be connected to a source of suction pressure, such as a medial conduit or conduits 210*b*.

An unbroken portion of the backing pad 200 refers to a portion of the backing pad 200 which contains no conduit or conduits 210*a*-210*c*, and therefore resists the flow of air to such a degree that air will flow substantially more freely along a conduit 210*a*-210*c* than through an unbroken portion of the backing pad 200. The purpose of conduits 210*a*-210*c* being separated from each other by unbroken portions of the backing pad 200 is to enable controlled conveyance of air through the conduits 210*a*-210*c* so that surface flushing can be brought about with air flowing from conduits not connected to suction pressure to conduits connected to suction pressure over the lower surface 250 of the backing pad 200. Such controlled conveyance of air would be disturbed if the flow of air was to leak from one conduit 210*a*-210*c* directly into another.

As the peripheral conduit or conduits 210*c* may extend into the medial region of the backing pad 200, the peripheral conduit or conduits 210*c* may extend to the distance of more than 10%, or 15%, or 20%, or 25%, or 30%, or 35% of the distance between the starting point of the peripheral conduit 210*c* at the outer side wall 220 and the center of the backing pad 200 in correspondence with what was said about the extent of the peripheral region above.

The technical effect of separating the medial conduits 210*b* adapted to be connected to suction pressure in an abrading system from conduits 210*a*,210*c* not adapted to be connected to suction pressure in the abrading system is to enable controlling the flow of air from ambient pressure to low, i.e. suction pressure in order to bring about even flow of air over and across the surface of the backing pad 200. In the embodiment illustrated in FIG. 7, the medial conduits 210*b* may be adapted to be connected to suction pressure in an abrading system, and the central conduit 210*a* and the peripheral conduits 210*c* may not be adapted to be connected to suction pressure.

The peripheral conduits 210*c* may pass through the outer side wall 220 of the backing pad 200. The peripheral conduits 210*c* may be elongated such that the peripheral conduits 210*c* may extend from the peripheral region of the backing pad 200 to its medial region such that the end of a peripheral conduit 210*c* which is nearest to the center of the backing pad 200 is nearer to the center of the backing pad 200 than the medial conduit 210*b* which is most distant from the center of the backing pad 200. The peripheral conduits 210*c* may extend in the direction of or towards the central conduit 210*a* and/or the central region.

Figure 6:
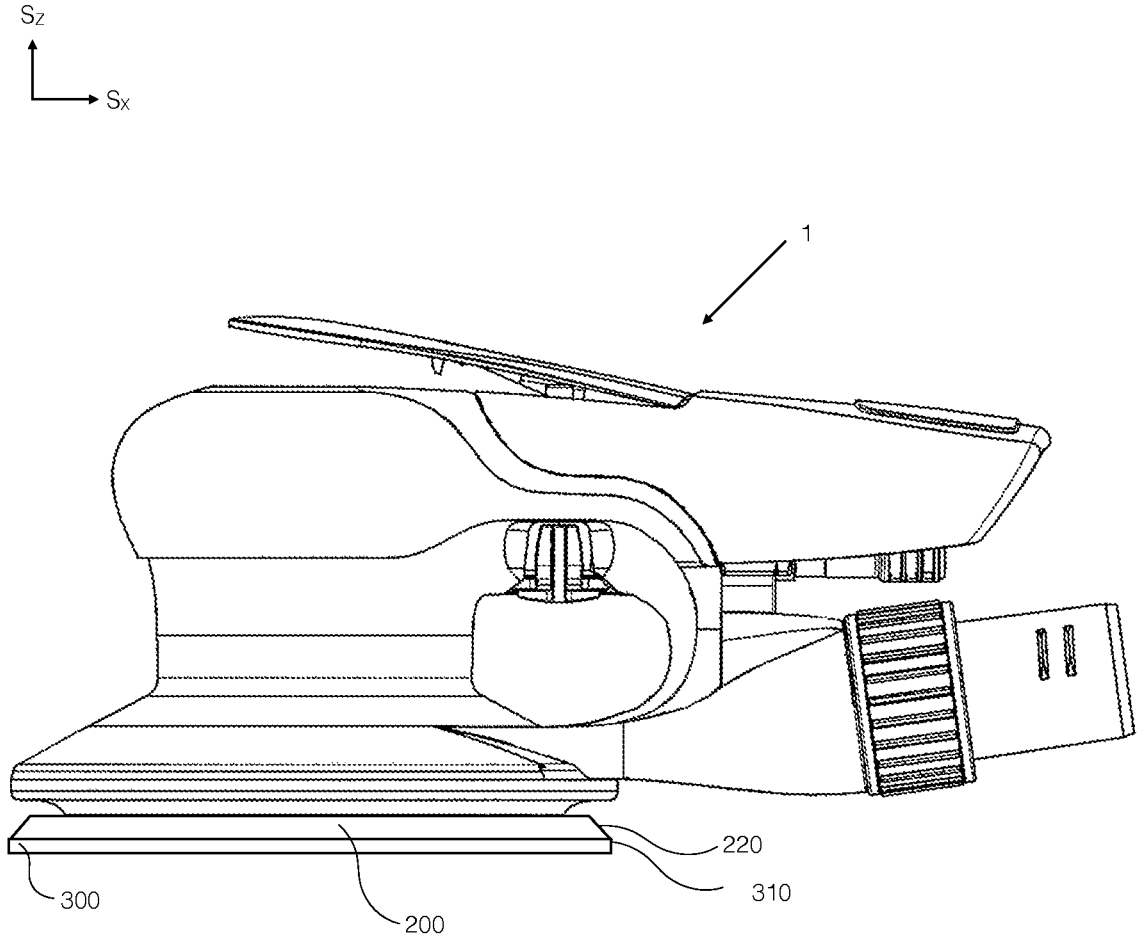
FIG. 6 illustrates an abrading apparatus 1 equipped with a backing pad 200 and an abrading article 300.
Figure 12:
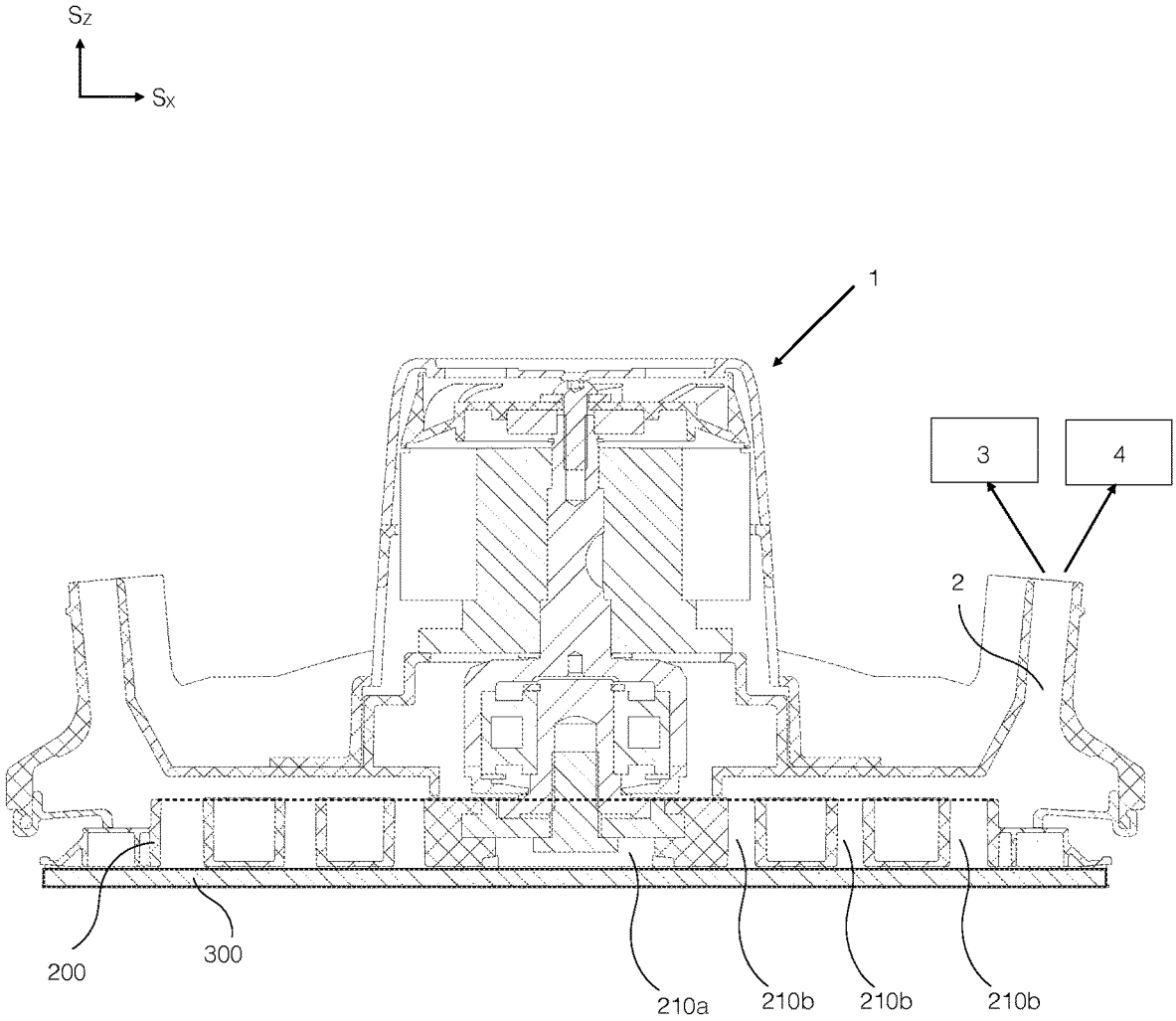
FIG. 12 illustrates a cross section view of an abrading apparatus 1 with conduits 2, and the apparatus 1 equipped with a backing pad 200 and an abrading article 300.

If suitably used as a part of an abrading system, as illustrated in FIGS. 6 and 12, the central and peripheral conduits 210*a* and 210*c* may be used for introducing incoming air onto the lower surface 250 of the backing pad 200, and the medial conduits 210*b* may be used for conveying air and debris away from the said surface.

FIG. 7 illustrates the configuration of the conduits 210*a*-210*c* according to a specific embodiment. In this embodiment there is at least one central conduit 210*a* located in the central region; a plurality of medial conduits 210*b* located in the medial region such that the medial conduits 210*b* are arranged along three concentric circles which are concentric with the center of the backing pad 200 with each concentric circle having several medial conduits 210*b*, for example eight medial conduits 210*b*, preferably with equal mutual distances; and several peripheral conduits 210*c*, for example eight peripheral conduits 210*c*, preferably with equal mutual distances, which peripheral conduits 210*c* pass through the outer side wall 220 of the backing pad 200. The central conduits 210*a* and/or the medial conduits 210*b* may be circular on the lower surface 250 of the backing pad 200.

The peripheral conduits 210*c* may be elongated such that the peripheral conduits 210*c* extend towards the center of the backing pad 200 and into its the medial region so that the ends of the peripheral conduits 210*c* extend towards the center of the backing pad 200 to the distance of more than half of the radius of the backing pad 200.

FIGS. 11*a* through 11*f* illustrate examples of different conduit configurations which may be used in other embodiments of the backing pad 200, or from which specific conduit geometries may be adopted into the backing pad 200 provided with the conduits 210*a*-210*c*. According to an example configuration illustrated in FIG. 11*a*, there may be a plurality of elongated peripheral conduits having a curvature. According to an example illustrated in FIG. 11*b*, there may be a plurality of elongated peripheral conduits with branching. According to an example illustrated in FIG. 11*c*, there may be more than one type of elongated peripheral conduits such that there may be a plurality of branching peripheral conduits and a plurality of non-branching peripheral conduits. According to an example illustrated in FIG. 11*d*, there may be a branching central conduit, and there may be a plurality of elongated peripheral conduits such that some of the elongated peripheral conduits extend from the peripheral region of the backing pad 200 to its medial region in a direction other than towards the center of the backing pad 200. According to an example illustrated in FIG. 11*e*, there may be a plurality of elongated medial conduits with branching. According an example illustrated in FIG. 11*f*, there may be a plurality of elongated peripheral conduits with an angle. While FIGS. 11*a* through 11*f* illustrate examples of different conduit configurations on the circular backing pad 200, the illustrated geometrical principles may be implemented on the backing pad 200 with a different shape, such as rectangular or triangular, as well.

In the specific embodiment illustrated in FIG. 7, the central conduit 210*a* and the medial conduits 210*b* may extend through the entire thickness of the backing pad 200 on the $S_Z$ axis. That is, in this embodiment, the central conduit 210*a* and the medial conduits 210*b* may extend from the upper surface 260 of the backing pad 200 to its lower surface 250. In the same specific embodiment, the peripheral conduits 210*c* may extend on the $S_Z$ axis through the lower surface layer 240 and partially, but not entirely, through the body 230 of the backing pad 200. That is, in this embodiment, the peripheral conduits 210*c* may have orifices on the lower surface 250 and the outer side wall 220, but not on the upper surface 260.

Figure 9A:
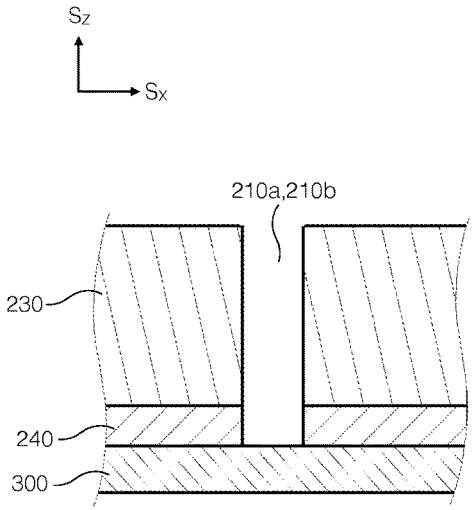
FIGS. 9*a* through 9*e* illustrate different exemplary types of conduits 210*a-c* in a backing pad 200 as attached to an abrading article 300.
Figure 9B:
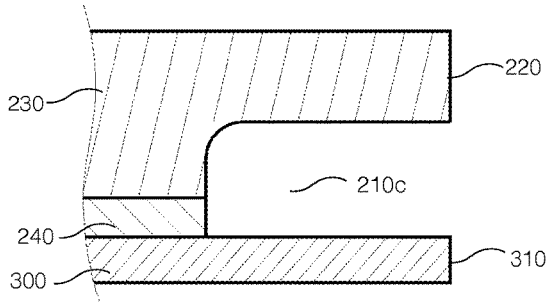

According to this specific embodiment, the central conduit 210*a* and/or the medial conduits 210*b* may be of the conduit type illustrated in FIG. 9*a*, i.e. holes which extend through the entire thickness of the backing pad 200, and the peripheral conduits may be of the type illustrated in FIG. 9*b*, i.e. a groove on the lower surface 250 of the backing pad 200, the groove being open towards the abrading article 300 as shown in FIG. 7. Preferably, as shown in FIG. 7, the groove has an open end at the outer side wall 220 and at least one opposite, closed end.

As illustrated in the cross section A-A of FIG. 7, the medial conduits 210*b* which extend through the entire thickness of the backing pad 200 may be branched such that a medial conduit 210*b* has fewer number of orifices on the upper surface 260 than on the lower surface 250, or vice versa.

Figure 9C:
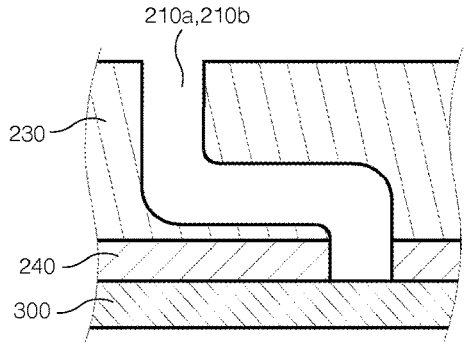
Figure 9D:
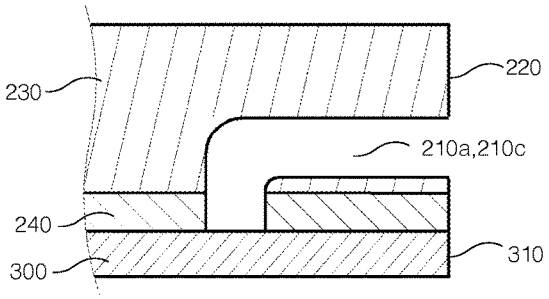

FIG. 9*d* illustrates an example of the central conduit 210*a*, which originates from and passes through the outer side wall 220 of the backing pad 200, travels within the body 230 and may be configured puncture the lower surface layer 240 and the lower surface 250 in a desired location, including the center of the backing pad 200. This conduit type may be used as the peripheral conduit 210*c* with an elongated orifice on the lower surface 250, with elongation meaning that the length of the orifice is at least 10% or 25% or 100% or 200% greater than the width of the orifice. In such a case the peripheral conduit 210*c* comprises a groove on the lower surface 250 with two closed ends and an orifice on the outer side wall 220, the groove being open towards the abrading article 300. In other words, in this case the peripheral conduit 210*c* resembles a groove like illustrated in FIG. 9*b* and FIG. 7 with the difference that the groove itself is not open at the outer side wall 220.

Figure 9E:
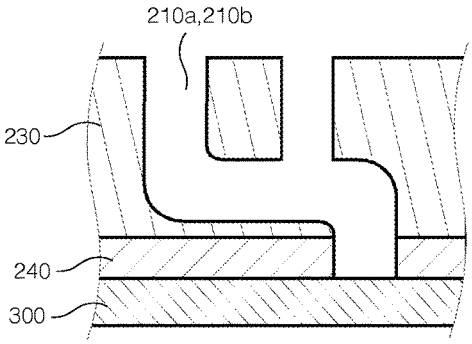

FIGS. 9*c* and 9*e* illustrate the central conduit 210*a* and the medial conduit 210*b* with orifices transversally offset on the $S_X$, $S_Y$ plane in the body 230 and the lower surface layer 240. This enables advantageous configuring of conduits on the lower surface 240 of the backing pad 200 differently from the conduit configuration in the abrading apparatus 1. The cross section A-A in FIG. 7 illustrates this in the case of the medial conduits 210*b*.

FIGS. 9*c*, 9*d* and 9*e* illustrate conduit types which may be employed in other embodiments of the backing pad 200 premised on the layer structure illustrated in FIG. 8. The same principles of conduit types as illustrated in FIG. 9*a* through 9*e* may be employed in embodiments in which the body 230 comprises two or more plies.

In the backing pad 200, each group of conduits, i.e. the central conduits 210*a*, the medial conduits 210*b*, and/or peripheral conduits 210*c*, may employ a different type of conduit as explained above. Furthermore, each said group of conduits may employ different types of conduits within that group such that more than one of the conduit types explained above and illustrated in FIG. 9*a* to FIG. 9*e* may be used within a group of conduits.

The backing pad 200 according to the specific embodiment illustrated in FIG. 7 and FIG. 8, i.e. an embodiment with the central conduit 210*a* and the medial conduits 210*b* of the type illustrated in FIG. 9*a* and the peripheral conduits 210*c* of the type illustrated in FIG. 9*b*, may be manufactured for example by molding the body 230 with a suitable plastic such as polypropylene, drilling the central conduit 210*a* and the medial conduits 210*b* into the body 230, milling the peripheral conduits 230*c* into the body 230, punching the lower surface layer 240 with the orifices of the central conduit 210*a*, the medial conduits 210*b* and the peripheral conduits 210*c* from a sheet of suitable material such as a sheet of hook-and-loop fabric, and adhesively attaching the body 230 and the lower surface layer 240 together.

The backing pad 200 comprising the conduits 210*a*-210*c* of the types illustrated in FIGS. 9*c*, 9*d* and/or 9*e* may be manufactured for example by manufacturing additively, such as with three-dimensional printing, the body 230 comprising the conduits 210 with materials known suitable for three-dimensional printing such as nylon, polyamide or ABS, punching the lower surface layer 240 with the orifices of the central conduit 210*a*, the medial conduits 210*b* and/or the peripheral conduits 210*c* from a sheet of suitable material such as a sheet of hook-and-loop fabric, and adhesively attaching the body 230 and the lower surface layer 240 together.

The backing pad 200 as explained above may be used in an abrading system comprising an abrading apparatus 1 and the backing pad 200, as illustrated in FIG. 6 according to one embodiment. During abrading a workpiece with such an abrading system, an abrading article 300 may be attached to the backing pad 200. The abrading article 300 is preferably porous and most preferably an abrading net which comprises an open mesh, which mesh is coated with abrasive particles and comprises a plurality of openings. During abrading, the abrading apparatus 1 may rotate and/or oscillate the backing pad 10. Such rotation and/or oscillation may be brought about by a source of power of the abrading apparatus 1 such as an electric or a pneumatic motor The abrading article 300 and the backing pad 200 may be of any shape on the $S_X$, $S_Y$ plane, such as rectangular, triangular, or preferably round if rotating. Advantageously, the backing pad 200 and the abrading article 300 are substantially of the same shape. The abrading article 300 may be, for example, of conventional, known type, or it may incorporate the principles of the solution disclosed for the abrading article 400. If the abrading article 300 comprises central, medial and/or peripheral conduits, all or some of such conduits may be aligned with the central, medial and/or peripheral conduits 210*a*-210*c* of the backing pad in accordance with the air conveyance principles described above.

It is to be generally understood that for conduits to be aligned, the conduits do not necessarily have to be geometrically perfectly aligned such that, for example, their orifices would perfectly match each other without any geometrical offset or difference in area, or that the conduits would need to be hermetically coupled to each other. Instead, conduits are to be understood to be aligned when they constitute a functional air and/or debris conveyance pathway, i.e. it is possible to convey air and/or debris from one conduit into another.

An embodiment of the abrading system is illustrated in cross section in FIG. 12, wherein the backing pad 200 comprises the central conduit 210*a* and a plurality of the medial conduits 210*b* of the conduit type depicted in FIG. 9*a*, and further may comprise a plurality of the peripheral conduits 210*c* (not visible in the cross section in FIG. 12) of the conduit types depicted in FIG. 9*b*. In this embodiment, the medial conduits 210*b* of the backing pad 200 may be connected to suction pressure through the conduits 2 of the abrading apparatus 1. The conduits 2 of the abrading apparatus 1 may be connected to, or are adapted to be connected to, a source of suction pressure 3 which may comprise a debris collection receptacle 4.

During operation of the abrading system according to this embodiment, the central conduit 210*a* of the backing pad 200 may convey incoming air onto the lower surface 250 of the backing pad 200. The peripheral conduits 210*c* (not visible in the cross section in FIG. 12), extending on the $S_X$, $S_Y$ plane from the medial region of the backing pad 200 to its peripheral region and through its outer side wall 220, as illustrated according to one embodiment in FIG. 7, may be blind in that the peripheral conduits 210*c* are not connected with the medial conduits 210*b*, the central conduit 210*a* or the conduits 2 in the abrading apparatus 1 in such a way that any air passing through the peripheral conduits 210*c* could travel into the medial conduits 210*b*, the central conduit 210*a* or the conduits 2 in the abrading apparatus 1 without first travelling over a portion of the lower surface 250 of the backing pad 200.

In this embodiment, during abrading, abrading debris may be extracted from the lower surface 250 of the backing pad 200, that is from the space between the backing pad 200 and the abrading article 300 housing their attachment elements, with suction pressure through the medial conduits 210*b* of the backing pad 200 into the conduits 2 of the abrading apparatus 1. The extracted abrading debris may be conveyed into a debris collection receptacle 4. Replacement air, pulled in by suction pressure onto the lower surface 250 of the backing pad 200, may originate through the central conduit 210*a*, the peripheral conduits 210*c* and over the outer side wall 220 of the backing pad 200. Thus, the peripheral conduits 210*c* are not connected to suction pressure. As the peripheral conduits 210*c* may be blind, as explained above, incoming air through these conduits may be forced to pass over the lower surface 250 of the backing pad 200 before reaching the nearest suction pressure-connected medial conduit 210*b*, thereby providing surface flushing which extends substantially into the medial regions of the backing pad 200. FIG. 10*a* illustrates the flow of air on the lower surface 250 of the backing pad 200 according to this embodiment.

Furthermore, if the abrading article 300 is porous such an abrading net which comprises an open mesh, which mesh is coated with abrasive particles and comprises a plurality of openings, during abrading, abrading debris may move from the abrading article 300 onto the lower surface 250 of the backing pad 200, and the lower surface of the abrading article 300 may be flushed in a similar manner as the lower surface 250 of the backing pad 200.

In other embodiments of the backing pad 200, conduits 210*a*-210*c* may be differently configured on the $S_X$, $S_Y$ plane, such as according to the examples illustrated in examples in FIGS. 11*a* through 11*f*. Additional conduit configurations may be designed for example by combining conduit types illustrated in FIGS. 11*a* through 11*f*. Different such configurations may be designed to manage the incoming and outgoing airflows in different applications, including different shapes of the backing pad 200 and the abrading article 300, such that the lower surface 250 of the backing pad 200 may be evenly flushed with air in order to extract abrading debris evenly over the whole surface of the backing pad 200, as illustrated according to one embodiment in FIG. 10*a*.

In yet other embodiments of the backing pad 200, the central conduit or conduits 210*a* may be connected to suction pressure and thereby function as air and debris extraction conduits, instead of conveying incoming air onto the lower surface 250 of the backing pad 200. In such embodiments, the central conduit or conduits 210*a* may therefore function similarly to the medial conduits 210*b* according to what has been described above. Such embodiments may otherwise adhere to the principles of the solution as described above. Thus, in such embodiments incoming air may originate through the peripheral conduits 210*c* and over the outer side wall 220 of the backing pad 200 and be forced to pass over the lower surface 250 of the backing pad 200 before reaching the nearest suction pressure-connected central or medial conduit 210*b*,210*a* thereby providing surface flushing which extends substantially into the medial and central regions of the backing pad 200.

Abrading Article

Figure 13A:
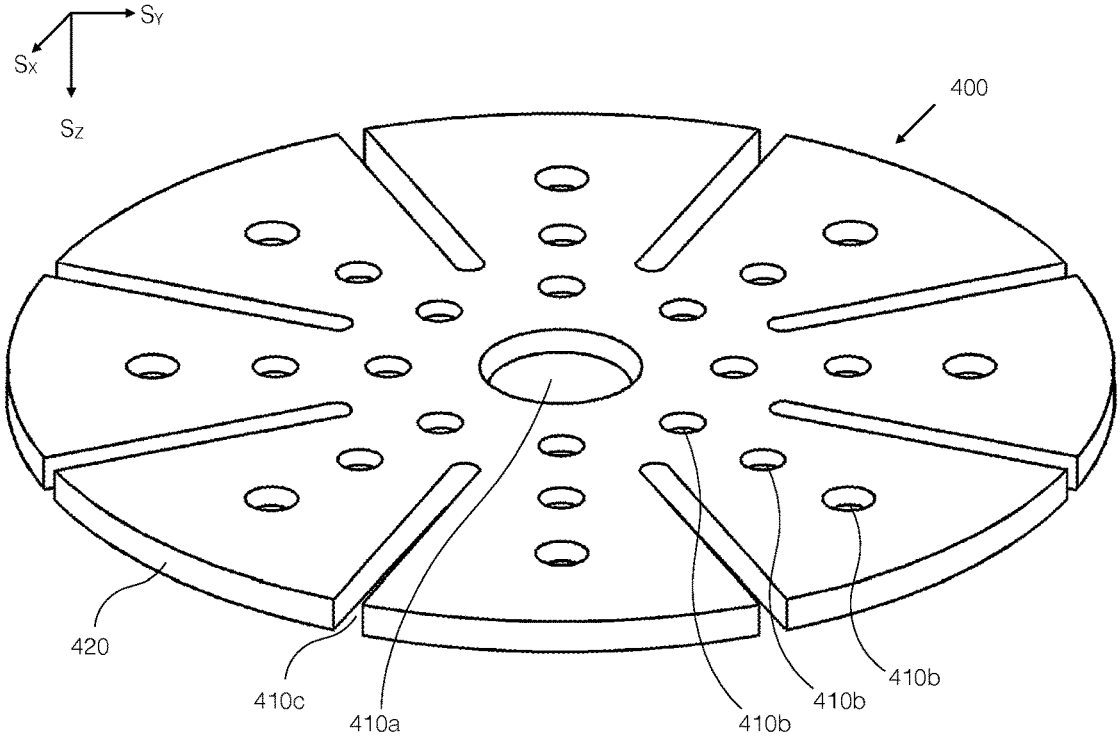
FIG. 13*a* illustrates an example embodiment of an abrading article 400 as viewed from below.
Figure 13B:
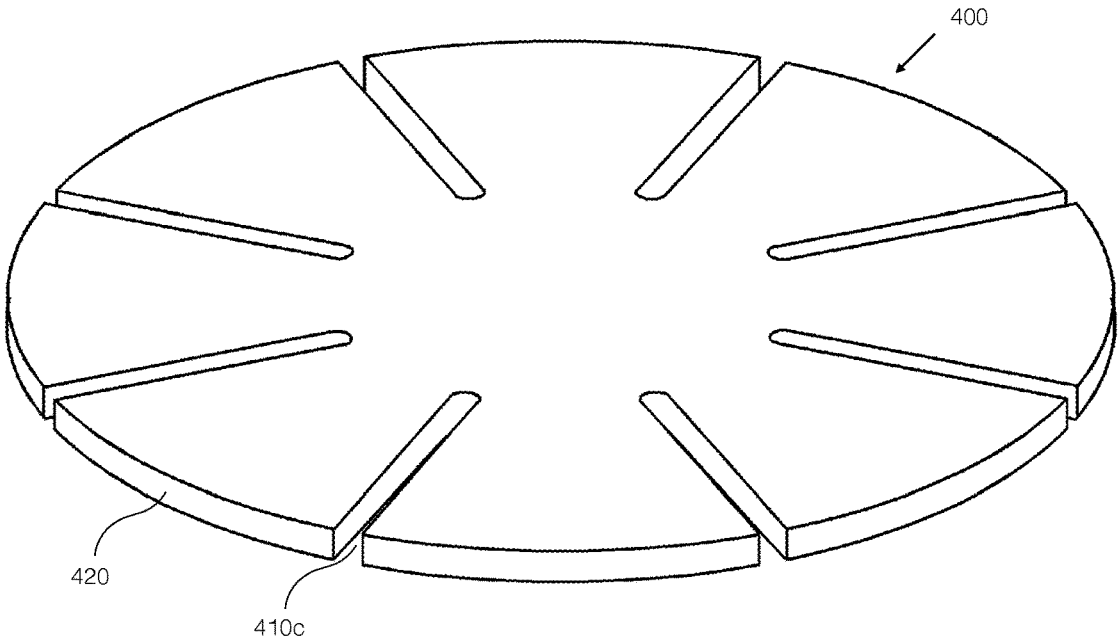
FIG. 13*b* illustrates an example embodiment of an abrading article 400 as viewed from below.
Figure 13C:
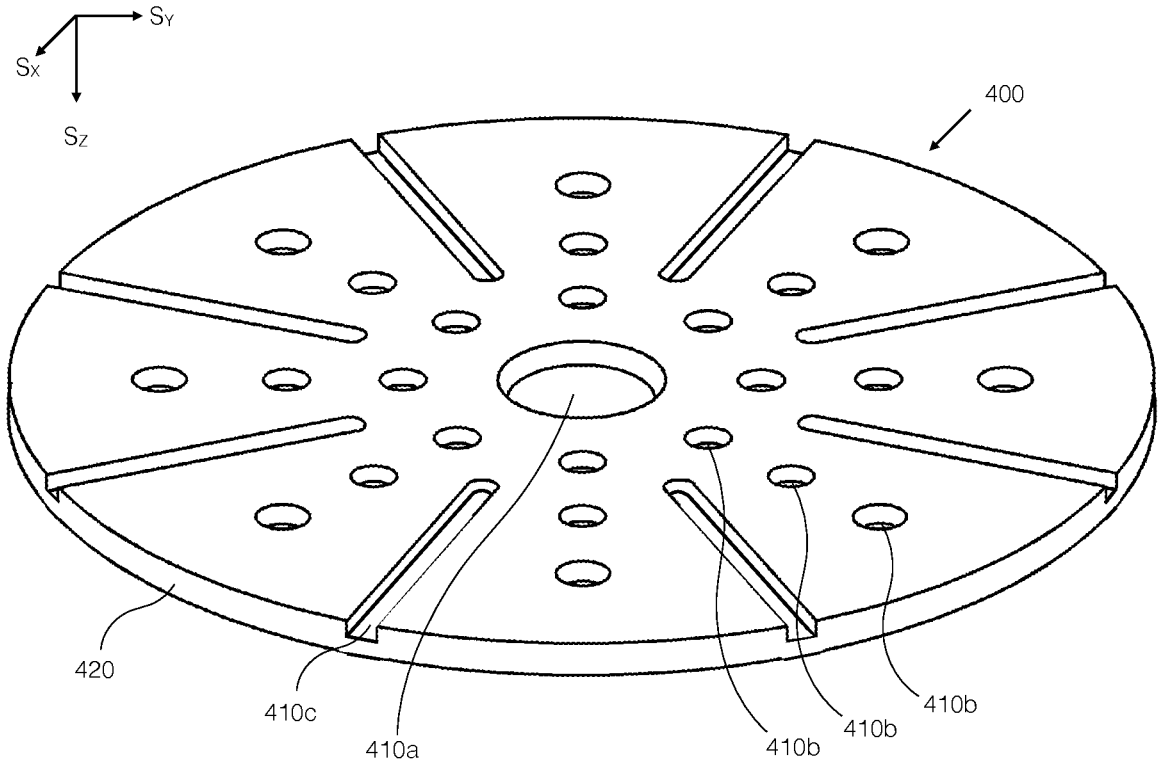
FIG. 13*c* illustrates an example embodiment of an abrading article 400 as viewed from below.

An abrading article 400 according to one example embodiment is shown in FIG. 13*a*. An abrading article 400 according to another example embodiment is shown in FIG. 13*b*. An abrading article 400 according to yet another example embodiment is shown in FIG. 13*c*.

The abrading article 400 may have a plurality of conduits 410*a*-410*c* for desirably directing flows of air, when used as a part of an abrading system used for abrading a work piece. Such desirable flows of air flush the surface or surfaces of the abrading article 400 evenly extracting abrading debris so that very little abrading debris remains on the surface or surfaces of the abrading article 400, with the resulting benefits that the lifetime of the abrading article 400 is increased and the abrading process is not impaired by accumulated debris in the system and/or on the surface of the abraded work piece. As is known, flows of air capture abrading debris and convey the captured abrading debris away from the surfaces of the abrading article 400 as the flows of air exit the surface of the abrading article 400.

Figure 14:
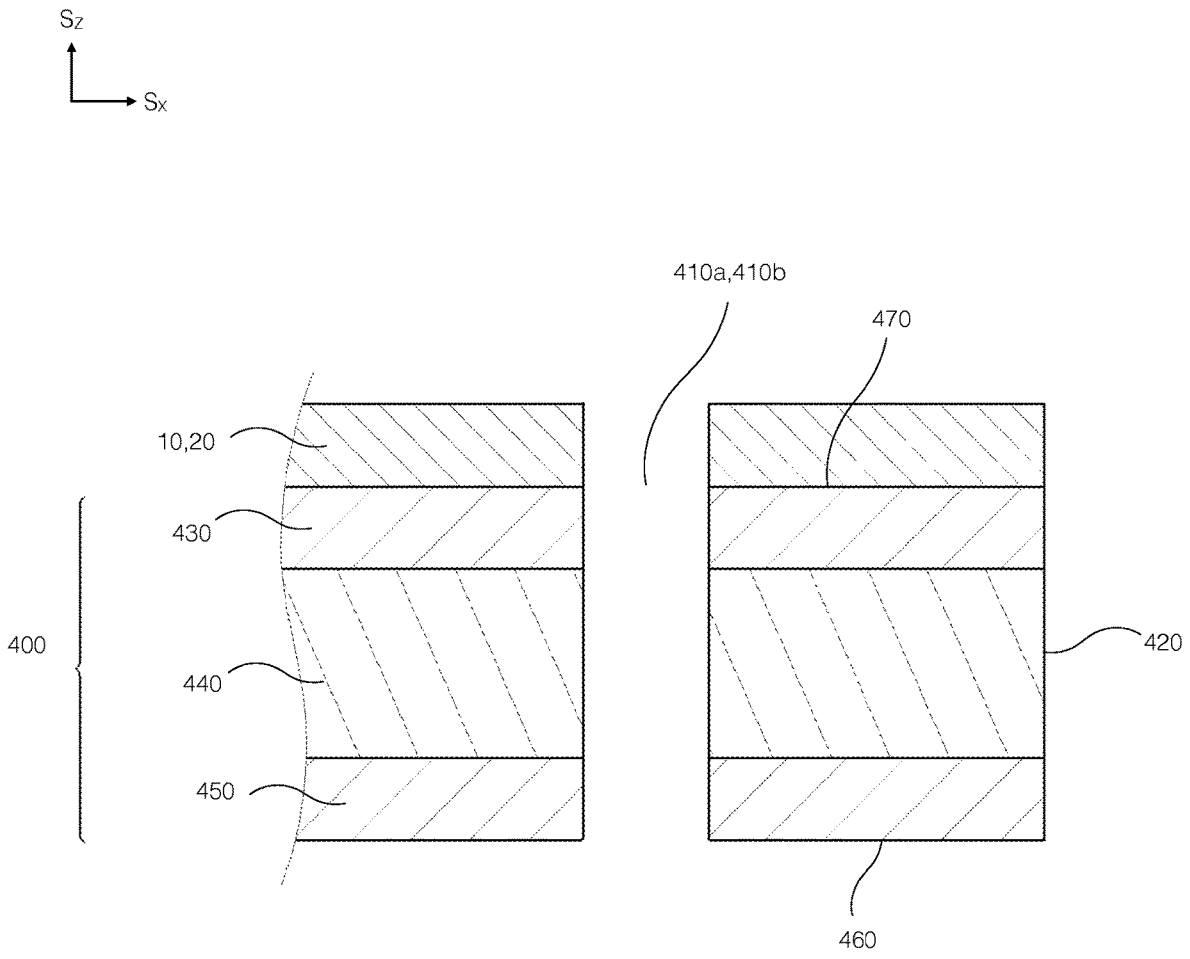
FIG. 14 illustrates a layer structure of an abrading article 400 as attached to a backing pad 10 or an intermediate pad 20.

The structure of the abrading article 400 according to an embodiment is illustrated in FIG. 14, as attached to a backing pad 10 or an intermediate pad 20. The intermediate pad 20 is adapted to be attached to the backing pad 10. The backing pad 10 and/or the intermediate pad 20 may be of the conventional, known type and thereby not comprising conduit arrangements according to the solution as disclosed. For example, the backing pad 10 may comprise a plurality of medial conduits, for example circular, and a central conduit, for example circular, but no peripheral conduits. Correspondingly, for example, the intermediate pad 20 may comprise, a plurality of medial conduits, for example circular, and a central conduit, for example circular, but no peripheral conduits According to the embodiment illustrated in FIG. 14, the abrading article 400 may comprise an upper surface layer 430, an intermediate layer 440 and a lower surface layer 450. In another embodiment, the abrading article 400 may comprise the upper surface layer 430 and the lower surface layer 450, and no intermediate layer. In yet another embodiment, the abrading article 400 may comprise the upper surface layer 430, the lower surface layer 450 and the intermediate layer 440 such that the intermediate layer 440 comprises two or more plies, which plies may be, for example, of different materials. All these structural embodiments may be applied in the embodiments of the abrading article 400 illustrated in FIGS. 13*a*-13*c*.

The abrading article 400 has an outer side wall 420 enclosing the upper surface layer 430, the lower surface layer 450, and the intermediate layer 440, if any. In the embodiment illustrated in FIG. 14, the outer side wall 420 has a wall surface which may be on a plane substantially perpendicular to the upper surface layer 430 and the lower surface layer 450. In other embodiments, the outer side wall 420 may be inclined such that the circumference of the abrading article 400 is greater at the lower surface 460 than at the upper surface 470, or vice versa.

The upper surface layer 430 may comprise attachment elements for attaching the abrading article 400 to the backing pad 10 or the intermediate pad 20. Such attachment elements may enable mechanical or adhesive attachment. Advantageously, such attachment enables removal and re-attachment. According to a preferred embodiment, attachment elements may comprise by hook-and-loop type of fastening with the capability for convenient re-attachment. In this preferred embodiment, the upper surface layer 430 of the abrading article 400 may comprise hooks and the lower surface layer of the backing pad 10 or the intermediate pad 20 may comprise loops, or vice versa.

In another embodiment, the, attachment elements may be premised on pressure sensitive adhesion, i.e. PSA. In such an embodiment, the upper surface layer 430 of the abrading article 400 may comprise pressure sensitive adhesive and the lower surface layer of the backing pad 10 or the intermediate pad 20 may comprise an even surface adapted for pressure sensitive adhesion, or vice versa.

In the embodiment depicted in FIG. 14 which comprises the intermediate layer 440 and in such embodiments that comprise the intermediate layer 440 comprising multiple plies, the thickness and the material or materials of the intermediate layer 440 may be selected according to application. Examples of design choices concerning the characteristics of the intermediate layer 440 may include absorption of mechanical vibration, absorption of sound, weight, recyclability, cost, manufacturability, plasticity, and the attachability to the other layers of the abrading article 400. Such choices may affect the controllability of the abrading system as well as the quality of the abraded surface.

In the embodiment comprising the intermediate layer 440 and illustrated in FIG. 14, examples of materials which the intermediate layer 440 may include soft materials such as foamed polypropylene, foamed polyethylene, foamed acryleonitrilebutadienstyrene, foamed polyurethane, foamed polyamide, foamed ethylene vinyl acetate or similar, and hard materials such as polypropylene, polyethylene, acryleonitrilebutadienstyrene, polyurethane, polyamide, aluminum or similar.

The lower surface layer 450 may comprise abrasive material comprising abrasive particles such that the lower surface 460 may be used for abrading a work piece.

According to a preferred embodiment, the lower surface layer 450 may comprise an open mesh, which mesh may be coated with abrasive material comprising abrasive particles, and which mesh may comprise a plurality of openings. In such a preferred embodiment, the intermediate layer 440 may be of porous material which may allow air and abrading debris to traverse the intermediate layer 440. In a variation of such a preferred embodiment, the abrading article 400 does not comprise an intermediate layer 440, in which case the lower surface layer 450 may be attached to the upper surface layer 430. Such a preferred structural embodiment, in which the structural lower surface layer 450 comprises an open mesh coated with abrasive material comprising abrasive particle and which comprises a porous intermediate layer 440, including its said variation which does not comprise an intermediate layer 440, may be advantageously combined with the embodiment of the abrading article 400 illustrated in FIG. 13*b*. Advantageousness relates to the plurality of small openings in the open mesh and the pores in the intermediate layer 440, if any, since they may bring about the air and debris extraction functionality commonly brought about by medial conduits 410*b* and/or the air conveyance functionality commonly brought about by central conduits 410*a*, which conduits are depicted in the embodiment in FIG. 13*a*.

According to another embodiment, the lower surface layer 450 may comprise abrasive grains adjoined to a resin. In such an embodiment, the surface layer 450 may further comprise, for example, a backing material, such as paper, cardboard, polymeric film or fabric, to which the abrasive grains adjoined to a resin are attached. Such a structural embodiment may be advantageously combined with the embodiment of the abrading article 400 illustrated in FIG. 13*a*, since the non-porosity of abrasive grains adjoined to a resin, especially on a non-porous backing material, typically may give raise to a need for the air and debris extraction functionality commonly brought about by medial conduits 410*b* and/or the air conveyance functionality commonly brought about by central conduits 410*a*, which conduits are depicted in the embodiment in FIG. 13*a*.

The abrading article 400 comprises a central region referring to the portion of the abrading article 400 at and near its center, a peripheral region referring to the portion of the abrading article 400 at and near its outer side wall 420, and a medial region referring to the portion of the abrading article 400 between the central and peripheral regions. The central region, the peripheral region and the medial region are defined on the $S_X$, $S_Y$ plane.

According to embodiments, as illustrated in FIGS. 13*a*-13*c*, in which the abrading article 400 has a circular shape, the central region may extend radially from the center of the abrading article 400 towards its outer side wall 420 to the distance of no more than 5%, or 10%, or 15%, or 20%, or 25%, or 30%, or 35% of the radius of the abrading article 400, and the peripheral region may extend radially from the outer side wall 420 of the abrading article 400 towards its center to the distance of at least 10%, or 15%, or 20%, or 25%, or 30%, or 35% of the radius of the abrading article 400.

In the specific embodiments depicted in FIGS. 13*a*-13*c*, the central region may extend radially from the center of the abrading article 400 towards its outer side wall 420 to the distance of 20% of the radius of the abrading article 400, and the peripheral region may extend radially from the outer side wall 420 of the abrading article 400 towards its center to the distance 20% of the radius of the abrading article 400.

In other embodiments with different shapes for the abrading article 400 on the $S_X$, $S_Y$ plane, such as the abrading article 400 being rectangular or triangular, the central region, the medial region, and the peripheral region may be similarly defined by replacing the notion of a radius with the distance between the center of the abrading article 400 and any given point at the outer side wall 420, for example, the nearest point with respect to the center of the abrading article 400.

The abrading article 400 may comprise a plurality of conduits 410*a*-410*c* which may terminate with orifices on the lower surface 460. The conduits 410*a*-410*c* do not refer to any minute openings within a porous material such as in some embodiments an open mesh in the lower surface layer 450 of the abrading article 400 or elsewhere, or in some embodiments porous material in the intermediate layer 440 or the upper surface layer 430 of the abrading article 400.

Such conduits may comprise a central conduit or conduits 410*a* located in or at least originating from the central region, a medial conduit or conduits 410*b* located in the medial region, and/or a peripheral conduit or conduits 410*c* originating from the peripheral region and extending into the medial region. Such conduits 410*a*-410*c* may be surrounded by an unbroken portion of the abrading article 400 such that no conduit 410*a*-410*c* extends into another conduit 410*a*-410*c*. The central conduit or conduits 410*a* and the peripheral conduit or conduits 410*c* may not be connected to a source of suction pressure, for example to a medial conduit or conduits 410*b*.

An unbroken portion of the abrading article 400 refers to a portion of the abrading article 400 which contains no conduit or conduits 410*a*-410*c*, and therefore resists the flow of air to such a degree that air will flow substantially more freely along a conduit 410*a*-410*c* than through an unbroken portion of the abrading article 400. The purpose of conduits 410*a*-410*c* being separated from each other by unbroken portions of the abrading article 400 is to enable controlled conveyance of air through the conduits 410*a*-410*c* so that surface flushing can be brought about with air flowing from conduits not connected to suction pressure to conduits connected to suction pressure over the surface of the abrading article 400. Such controlled conveyance of air would be disturbed if the flow of air was to leak from one conduit 410*a*-410*c* directly into another.

As the peripheral conduit or conduits 410*c* may extend into the medial region of the abrading article 400, the peripheral conduit or conduits 410*c* may extend to the distance of more than 10%, or 15%, or 20%, or 25%, or 30%, or 35% of the distance between the starting point of the peripheral conduit 410*c* at the outer side wall 420 and the center of the abrading article 400 in correspondence with what was said about the extent of the peripheral region above.

The technical effect of separating the medial conduits 410*b* adapted to be connected to suction pressure in an abrading system from conduits 410*a*,410*c* not adapted to be connected to suction pressure in the abrading system is to enable controlling the flow of air from ambient pressure to low, i.e. suction pressure in order to bring about even flow of air over and across the abrading surface 460. In the embodiment illustrated in FIG. 13*a*, the medial conduits 410*b* may be adapted to be connected to suction pressure in an abrading system, and the central conduit 410*a* and the peripheral conduits 410*c* may not be adapted to be connected to suction pressure.

The peripheral conduits 410*c* may pass through the outer side wall 420 of the abrading article 400. The peripheral conduits 410*c* may be elongated such that the peripheral conduits 410*c* may extend from the peripheral region of the abrading article 400 to its medial region.

In embodiments of the abrading article 400 which comprise the medial conduit or conduits 410*b* and the peripheral conduit or conduits 410*c*, and which may additionally comprise the central conduit or conduits 410*a*, the peripheral conduits 410*c* may be elongated such that the end of the peripheral conduit 410*c* which is nearest to the center of the abrading article 400 is nearer to the center of the abrading article 400 than the medial conduit 410*b* which is most distant from the center of the abrading article 400. The peripheral conduits 410*c* may extend in the direction of or towards the central conduit 410*a* and/or the central region FIG. 13*b* illustrates an embodiment of the abrading article 400 which comprises a plurality of the elongated peripheral conduits 410*c* and no central conduit and no medial conduits. In this embodiment, such a conduit configuration may be advantageously combined with a structure of the abrading article 400 according to which the abrading article 400 may comprise the upper surface layer 430 similar to the examples explained above which may comprise attachment elements enabling re-attachment such as premised on the hook-and-loop attachment as explained above; the lower surface layer 450 similar to the examples explained above which may comprise an open mesh, which mesh may be coated with abrasive particles and comprise a plurality of small openings; and the intermediate layer 440 which may be of porous material which may allow air and abrading debris to traverse the intermediate layer 440. In a variation of such a specific preferred embodiment, the abrading article 400 may not comprise the intermediate layer 440 similar to the examples explained above, in which case the lower surface layer 450 may be attached to the upper surface layer 430.

In the specific embodiment of FIG. 13*b* there are several peripheral conduits 410*c*, for example eight peripheral conduits 410*c*, preferably with equal mutual distances, which peripheral conduits 410*c* pass through the outer side wall 420 of the abrading article 400. The peripheral conduits 410*c* may be elongated such that the peripheral conduits 410*c* extend towards the center of the abrading article 400 and into its the medial region so that the ends of the peripheral conduits 410*c* extend towards the center of the abrading article 400 to the distance of more than half of the radius of the abrading article 400.

FIG. 13*a* illustrates an embodiment of the abrading article 400 which comprises a plurality of the elongated peripheral conduits 410*c*, the central conduit 410*a* and a plurality of the medial conduits 410*b*. The central conduit 410*a* and the circular medial conduits 410*b* may be circular. In a specific embodiment, such conduit configuration may be advantageously combined with the structure of the abrading article 400 according to which the abrading article 400 may comprise the upper surface layer 430 which may comprise attachment elements enabling re-attachment such as premised on the hook-and-loop attachment as explained above; and the intermediate layer 440; and the lower surface layer 450 which may comprise abrasive grains adjoined to a resin, and which lower surface layer 450 which may additionally comprise a backing material, such as paper, cardboard, polymeric film or fabric, to which the abrasive grains adjoined to a resin are attached.

In the specific embodiment of FIG. 13*a* there is at least one central conduit 410*a* located in the central region; a plurality of the medial conduits 410*b* located in the medial region such that the medial conduits 410*b* are arranged along three concentric circles which are concentric with the center of the abrading article 400 with each concentric circle having several medial conduits 400*b*, for example eight medial conduits 400*b*, preferably with equal mutual distances; and several peripheral conduits 410*c*, for example eight peripheral conduits 400*c*, preferably with equal mutual distances, which peripheral conduits 410*c* pass through the outer side wall 420 of the abrading article 400 and are elongated such that the peripheral conduits 410*c* extend towards the center of the abrading article 400 and into its the medial region so that the ends of the peripheral conduits

410*c* extend towards the center of the abrading article 400 to the distance of more than half of the radius of the abrading article 400.

FIG. 13*c* illustrates an embodiment of the abrading article 400 which is a variation of the embodiment illustrated in FIG. 13*a*. The variation-creating difference is that in the embodiment illustrated in FIG. 13*a* the peripheral conduits 410*c* may be slits which extend along the $S_Z$ axis through the entire thickness of the abrading article 400, whereas in the embodiment illustrated in FIG. 13*c* the peripheral conduits 410*c* may be grooves which do not extend through the entire thickness of the abrading article 400, but instead extend, for example, through or partially through the lower surface layer 450.

Figure 16:
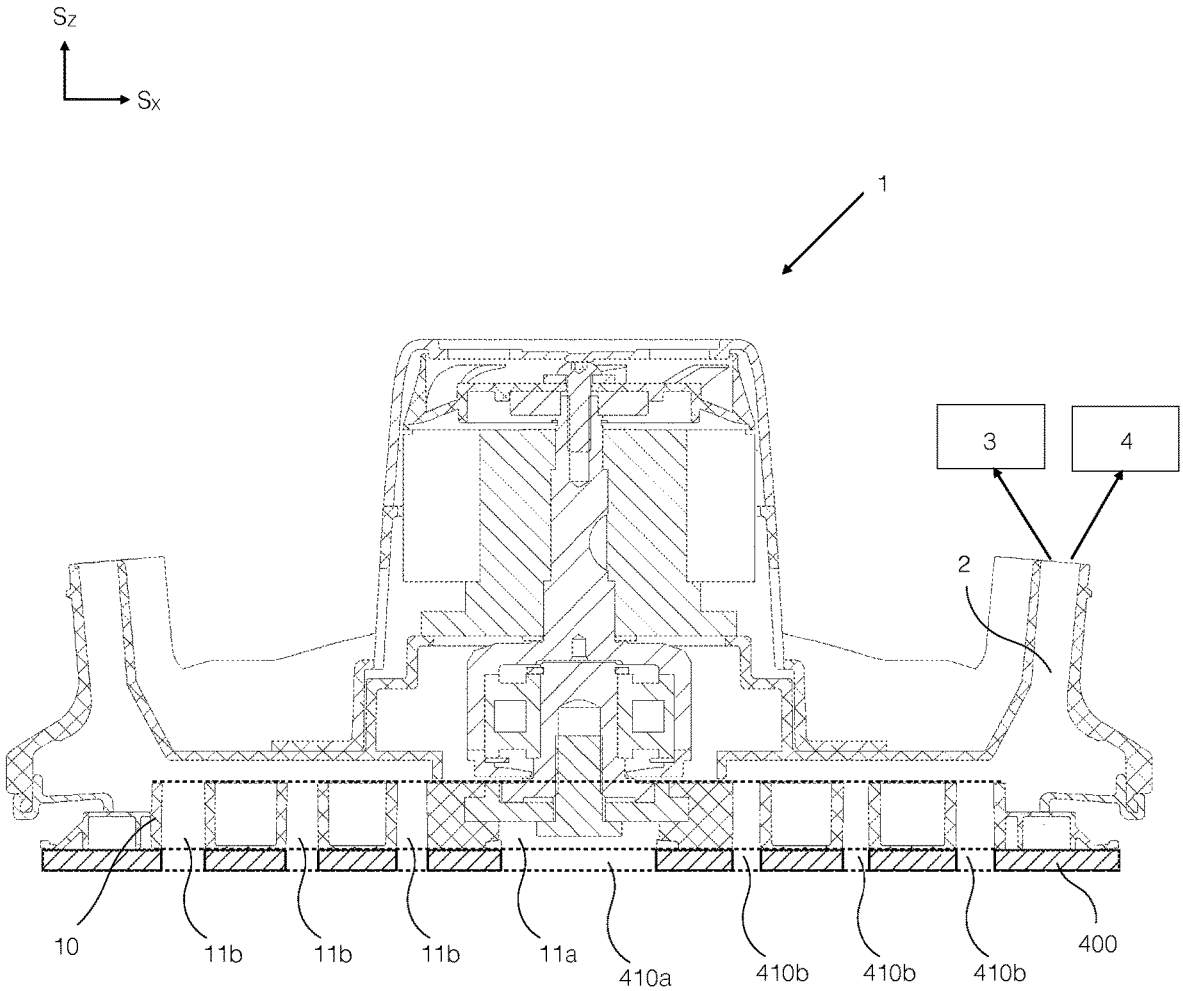
FIG. 16 illustrates a cross section view of an abrading apparatus 1 with conduits 2, and the apparatus 1 equipped with a backing pad 10 and an abrading article 400.
Figure 17A:
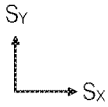
FIGS. 17*a* through 17*e* illustrate different exemplary configurations of peripheral conduits in an abrading article according to example embodiments with no central conduit and no medial conduits.
Figure 17A:
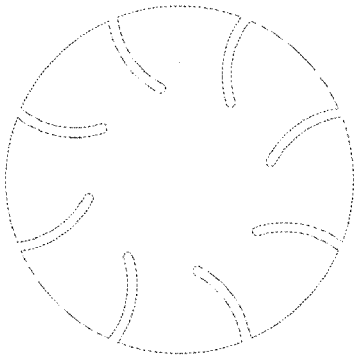
Figure 17B:
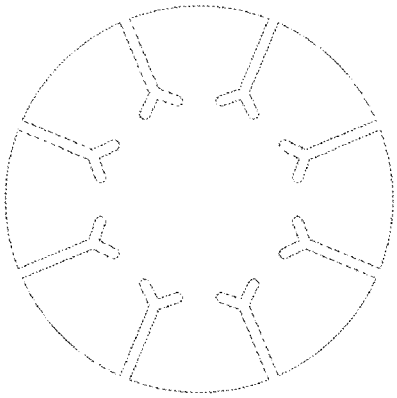
Figure 17C:
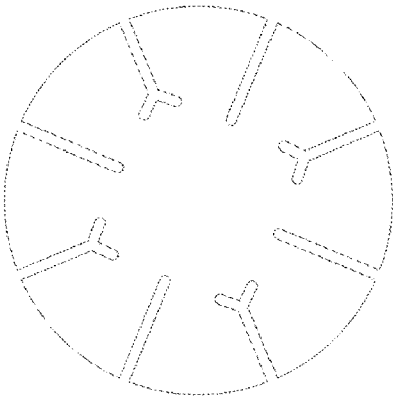
Figure 17D:
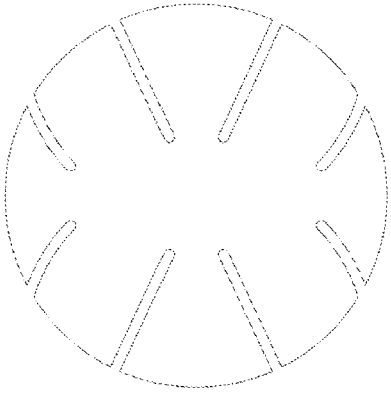
Figure 17E:
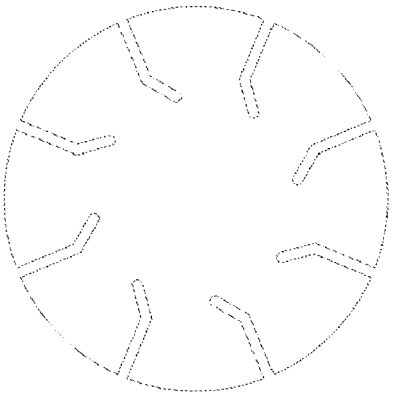
Figure 18:
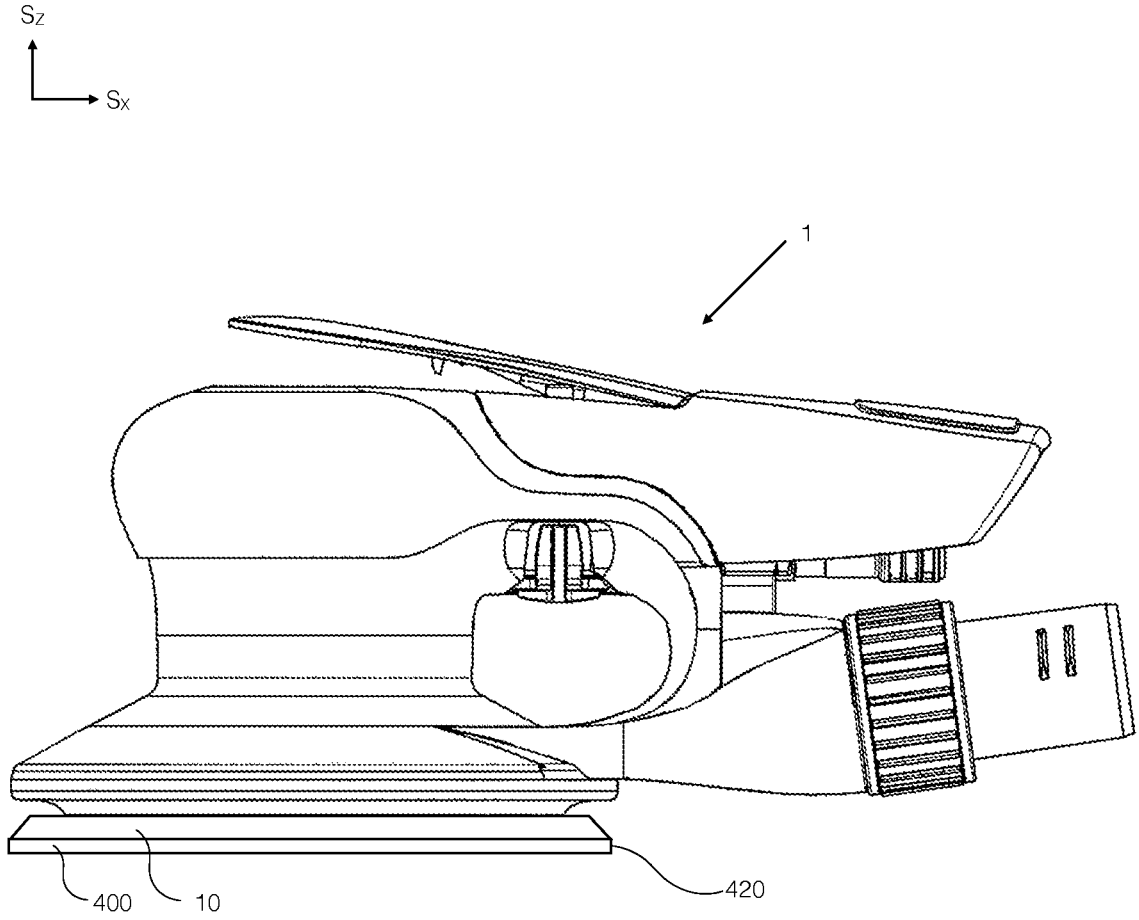
FIG. 18 illustrates an abrading apparatus 1 equipped with a backing pad 10 and an abrading article 400.

If suitably used as a part of an abrading system, as illustrated in FIG. 18 and FIG. 16 according to an example, the peripheral conduits 410*c* may be used for introducing incoming air onto the lower surface 460 and/or the upper surface 470 of the abrading article 400.

In the embodiments which comprise the central conduit or conduits 410*a*, the central conduit or conduits 410*a* may be used for introducing incoming air onto the lower surface 460 and/or the upper surface 470 of the abrading article 400. Correspondingly, in the embodiments which comprise the medial conduit or conduits 410*b*, the medial conduits 410*b* may be used for conveying air and debris away from the said surface or surfaces.

In embodiments without the central conduit 410*a* and the medial conduits 410*b* and wherein the lower surface layer 450 which may comprise an open mesh, which mesh may be coated with abrasive particles and comprise a plurality of small openings, air and debris may be conveyed away from the lower surface 460 through the holes, i.e. the small openings, between the said threads, and air and debris may be conveyed away from the upper surface 470 through conduits on the backing pad 10 or the intermediate pad 20.

FIGS. 11*a* through 11*f* illustrate examples of different conduit configurations which may be used in such embodiments of the abrading article 400 that comprise a plurality of the peripheral conduits 410*c*, the central conduit 410*a* and a plurality of the medial conduits 410*b*, or from which examples specific conduit geometries may be adopted into the abrading article 400 provided with the conduits 410*a*-410*c*. According to an example configuration illustrated in FIG. 11*a*, there may be a plurality of the elongated peripheral conduits having a curvature. According to an example illustrated in FIG. 11*b*, there may be a plurality of the elongated peripheral conduits with branching. According to an example illustrated in FIG. 11*c*, there may be more than one type of the elongated peripheral conduits such that there may be a plurality of the branching peripheral conduits and a plurality of the non-branching peripheral conduits. According to an example illustrated in FIG. 11*d*, there may be a branching central conduit, and there may be a plurality of elongated peripheral conduits such that some of the elongated peripheral conduits extend from the peripheral region of the abrading article 400 to its medial region in a direction other than towards the center of the abrading article 400. According to an example illustrated in FIG. 11*e*, there may be a plurality of elongated medial conduits with branching. According an example illustrated in FIG. 11*f*, there may be a plurality of elongated peripheral conduits with an angle. While FIGS. 11*a* through 11*f* illustrate examples of different conduit configurations on the circular abrading article 400, the illustrated geometrical principles may be implemented on the abrading article 400 with a different shape, such as rectangular or triangular, as well.

FIGS. 17*a* through 17*e* illustrate examples of different conduit configurations in those embodiments of the abrading article 400 which comprise a plurality of the peripheral conduits similar to the peripheral conduits 410*c* explained above and no central conduit and no medial conduits. According to an example illustrated in FIG. 17*a*, there may be a plurality of the elongated peripheral conduits having a curvature. According to an example illustrated in FIG. 17*b*, there may be a plurality of the elongated peripheral conduits with branching. According to an example illustrated in FIG. 17*c*, there may be more than one type of the elongated peripheral conduits such that there may be a plurality of branching peripheral conduits and a plurality of non-branching peripheral conduits. According to an example illustrated in FIG. 17*d*, there may be a plurality of the elongated peripheral conduits such that some of the elongated peripheral conduits extend from the peripheral region of the abrading article 400 to its medial region in a direction other than towards the center of the abrading article 400. According an example illustrated in FIG. 17*e*, there may be a plurality of the elongated peripheral conduits with an angle. While FIGS. 17*a* through 17*e* illustrate examples of different conduit configurations on circular abrading articles 400, the illustrated geometrical principles may be implemented on the abrading article 400 with a different shape, such as rectangular or triangular, as well.

In the specific embodiments illustrated in FIG. 13*a* and FIG. 13*b*, the conduits 410*a*-410*c* may extend through the entire thickness of the abrading article 400 on the $S_Z$ axis. That is, in these embodiments, the conduits 410*a*-410*c* may extend from the upper surface 470 of the abrading article 400 to its lower surface 460. Hence, the conduits 410*a*-410*c* may extend through the entire thickness of the abrading article 400 on the $S_Z$ axis in the specific preferred embodiment explained above.

Figure 15A:
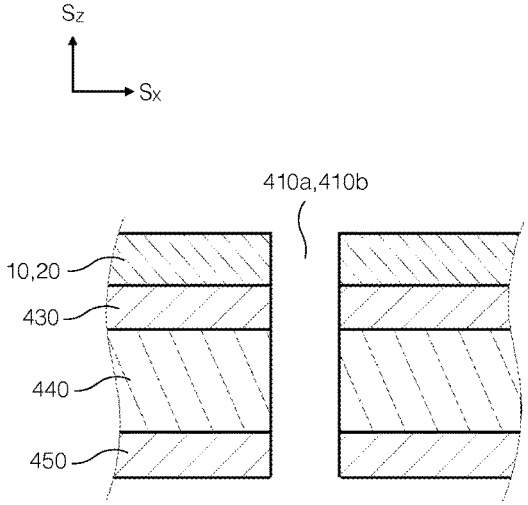
FIGS. 15*a* through 15*d* illustrate different exemplary types of conduits 410*a-c* in an abrading article 400 depicted in partial cross section as attached to a backing pad 10 or an intermediate pad 20.
Figure 15B:
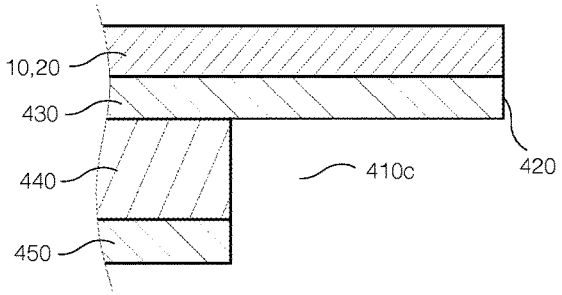
Figure 15C:
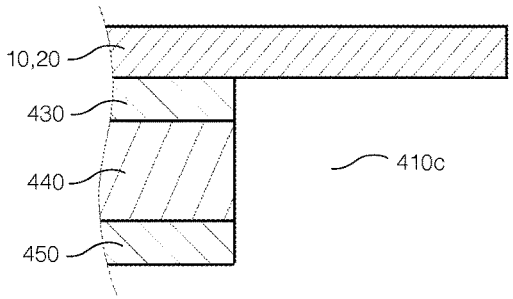

In the embodiment according to FIG. 13*a*, wherein the conduits 410*a*-410*c* extend through the entire thickness of the abrading article 400 on the $S_Z$ axis and wherein the abrading article 400 comprises the intermediate layer 440, the central conduits 410*a* and the medial conduits 410*b* may be of the type illustrated in cross section in FIG. 15*a*, i.e. holes which extend through the entire thickness of the abrading article 400, and the peripheral conduits 410*c* may be of the type illustrated in cross section in FIG. 15*c*.

In the embodiment according to FIG. 13*b*, wherein the conduits 410*a*-410*c* extend through the entire thickness of the abrading article 400 on the $S_Z$ axis and wherein the abrading article 400 comprises the intermediate layer 440, the peripheral conduits 410*c* may be of the type illustrated in cross section in FIG. 15*c*. This conduit type of the peripheral conduit 410*c* is for example a slit which extends through the entire thickness of the abrading article 400. Preferably, the slit has an open end at the outer side wall 420 and at least one opposite, closed end.

FIG. 15*b* illustrates the peripheral conduit 410*c* according to an embodiment where the peripheral conduit 410*c* extends on the $S_Z$ axis through the lower surface layer 450 and the intermediate layer 440 but not through the upper surface layer 430. This conduit type of the peripheral conduit 410*c* is for example a groove on the lower surface 460 of the abrading article 400, the groove being open towards the work piece. Preferably, the groove has an open end at the outer side wall 420 and at least one opposite, closed end.

Figure 15D:
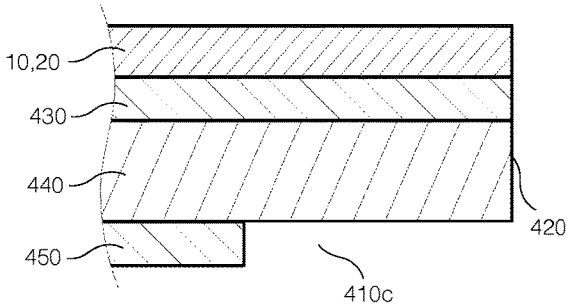

FIG. 15*d* illustrates the peripheral conduit 410*c* according to an embodiment where the peripheral conduit 410*c* extends on the $S_Z$ axis through or partially through the lower surface layer 450, but not through the upper surface layer 430 and not through the intermediate layer 440. This conduit type of the peripheral conduit 410*c* is for example a groove on the lower surface 460 of the abrading article 400, the groove being open towards the work piece. Preferably, the groove has an open end at the outer sidewall 420 and at least one opposite, closed end. In an example embodiment, such a groove may be formed by the absence of abrasive particles on the lower surface 460 in the area constituting the groove. In such an embodiment, therefore, the groove not comprising abrasive particles is recessed on the lower surface 460 in comparison to areas on the lower surface 460 surrounding the groove, which surrounding areas do comprise abrasive particles.

The principles of the conduit types of FIG. 15*a*, FIG. 15*c* and FIG. 15*d* may be employed also in the embodiments of the abrading article 400 which lack the intermediate layer 440, i.e. in embodiments in which the lower surface layer 450 is attached to the upper surface layer 430.

The abrading article 400 according to the embodiments illustrated in FIG. 13*a* and FIG. 13*b*, i.e. the embodiments comprising the conduits 410*a*-410*c* which extend through the entire thickness of the abrading article 400, i.e. from the upper surface 470 to the lower surface 460, may be manufactured for example by punching.

The abrading article 400 comprising a peripheral conduit or conduits 410*c* of the type illustrated in FIG. 15*d* may be manufactured by first manufacturing the abrading article 400 without such peripheral conduits 410*c* for example by punching as described above, and then making such peripheral conduits 410*c* for example by incusing them or additively printing onto the lower surface 460 except for in the areas of the peripheral conduits 410*c*.

For the specific embodiments of the abrading article 400 which are in accordance with FIG. 13*a* and FIG. 13*b* and which comprise the intermediate layer 440 as illustrated in FIG. 14, such punching may be carried out with suitable punches and dies, a sheet comprising the upper surface layer 430, the intermediate layer 440 and the lower surface layer 450. Such layers may be attached to each other adhesively prior to punching. Alternatively, such layers may be punched separately and attached to each other after punching, for example adhesively.

In the example of the abrading article 400 not comprising the intermediate layer 440 but otherwise in accordance with the said specific embodiments, such punching may be carried out with suitable punches and dies, a sheet comprising the upper surface layer 430 and the lower surface layer 450. Such layers may be attached to each other adhesively prior to punching. Alternatively, such layers may be punched separately and attached to each other after punching, for example adhesively.

Such a punching-based manufacturing may apply to the specific preferred embodiment of the abrading article 400 explained above.

The abrading article 400 as explained above may be used in an abrading system comprising an abrading apparatus 1, the backing pad 10 and the abrading article 400, as illustrated in FIG. 18 according to one embodiment. During abrading a work piece, the abrading apparatus 1 may rotate and/or oscillate the backing pad 10 and thereby rotate and/or oscillate the abrading article 400 as well. Such rotation and/or oscillation may be brought about by a source of power of the abrading apparatus 1 such as an electric or a pneumatic motor.

According to another embodiment, the abrading article 400 as explained above may be used in an abrading system comprising the abrading apparatus 1, the backing pad 10, an intermediate pad 20 and the abrading article 400. During abrading a work piece, the abrading apparatus 1 may rotate and/or oscillate the backing pad 10 and thereby rotate and/or oscillate the intermediate pad 20 and the abrading article 400 as well. Such rotation and/or oscillation may be brought about by a source of power of the abrading apparatus 1 such as an electric or a pneumatic motor.

The abrading article 400 and the backing pad 10 and the intermediate pad 20, if any, may be of any shape on the $S_X$, $S_Y$ plane, such as rectangular, triangular, or preferably round if rotating. Advantageously, the abrading article 400 and the backing pad 10 and the intermediate pad 20, if any, are substantially of the same shape. The backing pad 10 and the intermediate pad 20 may be, for example, of conventional, known type, or they may incorporate the principles of the solution disclosed for the backing pad 200 and the intermediate pad 100.

An embodiment of the abrading system is illustrated in cross section in FIG. 16, wherein the abrading article 400 is in accordance with the specific embodiment shown in FIG. 13*a*. In this embodiment, the central and medial conduits 410*a* and 410*b* of the abrading article 400 respectively are aligned with central and medial conduits 11*a* and 11*b* of the backing pad 10. Furthermore, the medial conduits 11*b* of the backing pad 10 are connected to the conduits 2 of the abrading apparatus 1. The conduits 2 of the abrading apparatus 1 may be connected to, or are adapted to be connected to, a source of suction pressure 3 which may comprise a debris collection receptacle 4.

It is to be generally understood that for conduits to be aligned, the conduits do not necessarily have to be geometrically perfectly aligned such that, for example, their orifices would perfectly match each other without any geometrical offset or difference in area, or that the conduits would need to be hermetically coupled to each other. Instead, conduits are to be understood to be aligned when they constitute a functional air and/or debris conveyance pathway, i.e. it is possible to convey air and/or debris from one conduit into another.

During operation of the abrading system, and in correspondence with what is illustrated in FIG. 10*a*, the central conduit 11*a* of the backing pad 10 may convey incoming air through the central conduit 410*a* of the abrading article 400 onto the lower surface 460 of the abrading article 400. In embodiments in which the attachment elements between the abrading article 400 and the backing pad 10 are of the hook-and-loop type, during operation of the abrading system, the central conduit 11*a* of the backing pad 10 may additionally convey incoming air through the central conduit 410*a* of the abrading article 400 into the interface between the abrading article 400 and the backing pad 10, which interface houses the attachment elements for attaching the abrading article 400 to the backing pad 10. The elongated peripheral conduits 410*c* depicted in FIGS. 13*a*-13*c*, but not visible in the cross section in FIG. 16, extending on the $S_X$, $S_Y$ plane from the medial region of the abrading article 400 to its peripheral region and through its outer side wall 420, may be blind in that there are no corresponding apertures or conduits on the backing pad 10 aligned with the peripheral conduits 410*c*.

In this embodiment of the abrading system, during abrading, abrading debris may be extracted from the lower surface 460 of the abrading article 400 with a suction pressure led through the medial conduits 410*b* of the abrading article 400, then through the medial conduits 11*b* of the backing pad 10 into the conduits 2 of the abrading apparatus 1. The extracted abrading debris may be conveyed into a debris collection receptacle 4. In embodiments in which the attachment elements between the abrading article 400 and the backing pad 10 are of the hook-and-loop type, debris may be similarly extracted from the interface between the abrading article 400 and the backing pad 10, which interface houses the attachment elements.

Replacement air, pulled in by suction pressure onto the lower surface 460 of the abrading article 400, may originate through the central conduit 410*a*, peripheral conduits 410*c* and over the outer side wall 420 of the abrading article 400. Thus, the peripheral conduits 410*c* are not connected to suction pressure. As the peripheral conduits 410*c* may be blind, as explained above, incoming air through these conduits may be forced to pass over the lower surface 460 of the abrading article 400 before reaching the nearest suction pressure-connected medial conduit 410*b*, thereby providing surface flushing which extends substantially into the medial regions of the abrading article 400. FIG. 10*a* illustrates the flow of air on the lower surface 460 of the abrading article 400 according to this embodiment.

In other embodiments of the abrading article 400, which comprise the central conduit 410*a*, a plurality of the medial conduits 410*b* and a plurality of the peripheral conduits 410*c*, conduits 410*a*-410*c* may be differently configured on the $S_X$, $S_Y$ plane, such as according to the examples illustrated in FIGS. 11*a* through 11*f*. Additional conduit configurations may be designed for example by combining conduit types illustrated in FIGS. 11*a* through 11*f*. Different such configurations may be designed to manage the incoming and outgoing airflows in different applications, including different shapes of the backing pad 10 and the abrading article 400, such that the lower surface 460 of the abrading article 400 and the interface between the abrading article 400 and the backing pad 10 may be evenly flushed with air in order to extract abrading debris evenly over the whole surface of the abrading article 400, as illustrated according to one embodiment in FIG. 10*a*.

In yet other embodiments of the abrading article 400, which comprise a plurality of the peripheral conduits 410*c* but not the central conduit 410*a* and not the medial conduits 410*b*, and in which the lower surface layer 450 may comprise an open mesh coated with abrasive particles, and in which the intermediate layer 440, if any, may be of porous material, such as the preferred specific embodiment explained above, the abrading article 400 may not comprise conduits which could be aligned with the central and/or medial conduits 11*a* and 11*b* of the backing pad 10, of which the medial conduits 11*b* of the backing pad 10 are aligned with the conduits 2 of the abrading apparatus.

In these embodiments, during operation of the abrading system, the central conduit 11*a* of the backing pad 10 may convey incoming air through the small openings in the open mesh in the lower surface layer 450 and through the pores of the porous intermediate layer 440, if any, of the abrading article 400 onto the lower surface 460 of the abrading article 400. In embodiments in which the attachment elements between the abrading article 400 and the backing pad 10 additionally are of the hook-and-loop type, during operation of the abrading system, the central conduit 11*a* of the backing pad 10 may additionally convey incoming air into the interface between the abrading article 400 and the backing pad 10, which interface houses the attachment elements for attaching the abrading article 400 to the backing pad 10. The elongated peripheral conduits 410*c* such as depicted in FIG. 13*b*, extending on the $S_X$, $S_Y$ plane from the medial region of the abrading article 400 to its peripheral region and through its outer side wall 420, may be blind in that there are no corresponding apertures or conduits on the backing pad 10.

In such embodiments of the abrading system, during abrading, abrading debris may be extracted from the lower surface 460 of the abrading article 400 with a suction pressure through the small openings in the open mesh in the lower surface layer 450 and through the pores of the porous intermediate layer 440, if any, of the abrading article 400, then through the medial conduits 11*b* of the backing pad 10 into the conduits 2. The extracted abrading debris may be conveyed into a debris collection receptacle 4. In such embodiments in which the attachment elements between the abrading article 400 and the backing pad 10 additionally are of the hook-and-loop type, debris may be extracted through the medial conduits 11*b* from the interface between the abrading article 400 and the backing pad 10, which interface houses the attachment elements.

In such embodiments, replacement air, pulled in by suction pressure onto the lower surface 460 of the abrading article 400, may originate through the central conduit 410*a*, peripheral conduits 410*c* and over the outer side wall 420 of the abrading article 400. Thus, the peripheral conduits 410*c* are not connected to suction pressure. As the peripheral conduits 410*c* may be blind, incoming air through these conduits may be forced to pass over a portion of the lower surface 460 of the abrading article 400 before entering into a plurality of small openings, thereby providing surface flushing which extends substantially into the medial regions of the abrading article 400. Furthermore, as the peripheral conduits 410*c* may be blind, incoming air through these conduits may be forced to pass over a portion of the upper surface 470 of the abrading article 400 before entering into the medial conduit 11*b* of the backing pad 10, thereby providing flushing of the interface between the abrading article 400 and the backing pad 10, which extends substantially into the medial regions of the abrading article 400 and the backing pad 10.

In other embodiments of the abrading article 400, which comprise a plurality of the peripheral conduits 410*c* but not the central conduit 410*a* and not the medial conduits 410*b*, conduits 410*c* may be differently configured on the $S_X$, $S_Y$ plane, such as according to the examples illustrated in FIGS. 17*a* through 17*e*. Additional conduit configurations may be designed for example by combining conduit types illustrated in FIGS. 17*a* through 17*e*. Different such configurations may be designed to manage the incoming and outgoing airflows in different applications, including different shapes of the backing pad 10 and the abrading article 400, such that the lower surface 460 of the abrading article 400 and the interface between the abrading article 400 and the backing pad 10 may be evenly flushed with air in order to extract abrading debris evenly over the whole surface of the abrading article 400.

In embodiments of the abrading system which additionally may comprise the intermediate pad 20 attached between the backing pad 10 and the abrading article 400, the air and debris flows during the operation of the abrading system may adhere to the same principles as explained above, because in such embodiments the intermediate pad 20 may comprise a central conduit or conduits and/or a medial conduit or conduits which may correspond to and be capable of being aligned with the central conduit or conduits 11*a* and the medial conduit or conduits 11*b* of the backing pad 10. In other words, in such embodiments, the conduit pattern on the intermediate pad 20 may substantially match the conduit pattern on the backing pad 10.

Below are presented example implementations of the invention:

Example 1: An intermediate pad suitable for use in an abrading system comprising an abrading apparatus adapted to provide suction pressure, the intermediate pad comprising:

an upper surface layer having an upper surface comprising attachment elements suitable for attaching the upper surface layer to a backing pad of the abrading apparatus;

a lower surface layer having a lower surface comprising attachment elements suitable for attaching the lower surface layer to an abrading article;

an intermediate layer between the upper surface layer and the lower surface layer, the intermediate layer being attached to the upper and lower surface layers and comprising one or more plies;

an outer side wall enclosing the upper surface layer, the lower surface layer and the intermediate layer;

at least one medial conduit suitable for conveying air and abrading debris from the lower surface, the at least one medial conduit terminating with an orifice on the lower surface; and at least one peripheral conduit suitable for conveying incoming air onto the lower surface, the at least one peripheral conduit extending from the outer side wall and terminating with an orifice on the lower surface, and being separated from the at least one medial conduit by an unbroken portion of the intermediate pad.

Example 2: The intermediate pad according to example 1, wherein the intermediate pad further comprises at least one central conduit, the at least one central conduit:

terminating with an orifice on the lower surface and being suitable for conveying incoming air onto the lower surface or conveying air and abrading debris from the lower surface; and being separated from the at least one medial conduit and the at least one peripheral conduit by an unbroken portion of the intermediate pad.

Example 3: The intermediate pad according to any of the preceding example, wherein the attachment elements on the upper surface layer and/or the lower surface layer enable re-attachment.

Example 4: The intermediate pad according to example 3, wherein the attachment elements on the upper surface layer are premised on hooks and loops, or mechanical fasteners, or pressure sensitive adhesion.

Example 5: The intermediate pad according to example 3 or 4, wherein the attachment elements on the lower surface layer are premised on hooks and loops, or mechanical fasteners, or pressure sensitive adhesion.

Example 6: The intermediate pad according to any of the preceding examples, wherein the at least one central conduit and/or the medial conduits is/are holes which extend through the upper surface layer, the intermediate layer and the lower surface layer of the intermediate pad.

Example 7: The intermediate pad according to any of the preceding examples, wherein the at least one peripheral conduit is a groove on the lower surface or a slit, the groove or the slit having an open end at the outer side wall.

Example 8: The intermediate pad according to any of the preceding examples, wherein at least one of the peripheral conduits extends towards the center of the intermediate pad past at least one of the medial conduits or to the distance of more than 10% of the distance between the starting point of the peripheral conduit at the outer side wall and the center of the intermediate pad.

Example 9: The intermediate pad according to any of the preceding examples, wherein the intermediate pad has a circular shape.

Example 10: The intermediate pad according to example 9, wherein the intermediate pad further comprises a plurality of the medial conduits arranged along at least one concentric circle which is/are concentric with the center of the intermediate pad.

Example 11: The intermediate pad according to any of the preceding examples, wherein at least one of the medial conduits or at least one of the peripheral conduits has an elongated orifice on the lower surface of the intermediate pad.

Example 12: The intermediate pad according to any of the preceding examples, wherein the intermediate layer comprises soft material such as foamed polypropylene, foamed polyethylene, foamed acryleonitrilebutadienstyrene, foamed polyurethane, foamed polyamide, foamed ethylene vinyl acetate or similar; or hard material such as polypropylene, polyethylene, acryleonitrilebutadienstyrene, polyurethane, polyamide, aluminum or similar.

Example 13: An intermediate pad suitable for use in an abrading system comprising an abrading apparatus adapted to provide suction pressure, the intermediate pad comprising:

an upper surface layer having an upper surface comprising attachment elements suitable for attaching the upper surface layer to a backing pad of the abrading apparatus;

a lower surface layer having a lower surface comprising attachment elements suitable for attaching the lower surface layer to an abrading article;

an outer side wall enclosing the upper surface layer and the lower surface layer;

at least one medial conduit suitable for conveying air and abrading debris from the lower surface, the at least one medial conduit terminating with an orifice on the lower surface; and at least one peripheral conduit suitable for conveying incoming air onto the lower surface, the at least one peripheral conduit extending from the outer side wall and terminating with an orifice on the lower surface, and being separated from the at least one medial conduit by an unbroken portion of the intermediate pad.

Example 14: The intermediate pad according to example 13, wherein the intermediate pad further comprises at least one central conduit, the at least one central conduit:

terminating with an orifice on the lower surface and being suitable for conveying incoming air onto the lower surface or being suitable for conveying air and abrading debris from the lower surface; and being separated from the at least one medial conduit and the at least one peripheral conduit by an unbroken portion of the intermediate pad.

Example 15: The intermediate pad according to examples 13 or 14, wherein the attachment elements on the upper surface layer and/or the lower surface layer enable re-attachment.

Example 16: The intermediate pad according to example 15, wherein the attachment elements on the upper surface layer are premised on hooks and loops, or mechanical fasteners, or pressure sensitive adhesion.

Example 17: The intermediate pad according to example 15 or 16, wherein the attachment elements on the lower surface layer are premised on hooks and loops, or mechanical fasteners, or pressure sensitive adhesion.

Example 18: The intermediate pad according to any of the examples 14-17, wherein the at least one central conduit and/or the medial conduits is/are holes which extend through the upper surface layer and the lower surface layer of the intermediate pad.

Example 19: The intermediate pad according to any of the examples 13-18, wherein the at least one peripheral conduit is a groove on the lower surface or a slit, the groove or slit having an open end at the outer side wall.

Example 20: The intermediate pad according to any of the examples 13-19, wherein the at least one peripheral conduit extends towards the center of the intermediate pad past at least one of the medial conduits or to the distance of more than 10% of the distance between the origin of the peripheral conduit at the outer side wall and the center of the intermediate pad.

Examples 21: The intermediate pad according to any of the examples 13-20, wherein the intermediate pad has a circular shape.

Examples 22: The intermediate pad according to example 21, wherein there is a plurality of the medial conduits arranged along at least one concentric circle which is/are concentric with the center of the intermediate pad.

Example 23: The intermediate pad according to any of the examples 13-22, wherein at least one of the medial conduits has an elongated orifice on the lower surface of the intermediate pad.

Example 24: An abrading system, comprising:

the intermediate pad according to any of the examples 1-12, or any of the examples 13-23;

an abrading apparatus adapted to provide suction; and a backing pad capable of being attached to the abrading apparatus, the backing pad comprising at least one medial conduit for conveying the suction pressure and capable of being aligned with at least one of the medial conduits of the intermediate pad for sucking air and abrading debris.

Example 25: A method of using the abrading system according to example 24 for removing abrading debris from the lower surface of the intermediate pad; the method comprising:

suction pressure in the conduits of the abrading apparatus being conveyed through the medial conduits of the backing pad into the medial conduits of the intermediate pad;

incoming air flowing due to the suction pressure onto the lower surface of the intermediate pad through the central conduit or conduits, if any, and through the peripheral conduits, and over the outer side wall of the intermediate pad; and said incoming air passing over unbroken portions of the intermediate pad between the lower surface of the intermediate pad and the abrading article before entering, as pulled in by the suction pressure, into the medial conduits of the intermediate pad.

Example 26: A method of using the abrading system according to example 24 for removing abrading debris from the lower surface of the intermediate pad; the method comprising:

suction pressure in the conduits of the abrading apparatus being conveyed through the central conduit or conduits of the backing pad into the central conduit or conduits if any, of the intermediate pad and through the medial conduits of the backing pad into the medial conduits of the intermediate pad;

incoming air flowing due to the suction pressure onto the lower surface of the intermediate pad through the peripheral conduits, and over the outer side wall of the intermediate pad; and said incoming air passing over unbroken portions of the intermediate pad between the lower surface of the intermediate pad and the abrading article before entering, as pulled in by the suction pressure, into the central conduit or conduits, if any, and the medial conduits of the intermediate pad.

Example 27: A backing pad suitable for use in an abrading apparatus adapted to provide suction pressure, the backing pad comprising:

a body comprising attachment elements suitable for attaching the body to the abrading apparatus;

a lower surface layer having a lower surface, the lower surface layer being attached to the body, and comprising attachment elements suitable for attaching the lower surface layer to an abrading article;

an outer side wall enclosing the body and the lower surface layer;

at least one medial conduit suitable for conveying air and abrading debris from the lower surface, the at least one medial conduit terminating with an orifice on the lower surface; and at least one peripheral conduit suitable for conveying incoming air onto the lower surface, the at least one peripheral conduit extending from the outer side wall and terminating with an orifice on the lower surface, and being separated from the at least one medial conduit by an unbroken portion of the backing pad.

Example 28: The backing pad according to example 27, wherein the backing pad further comprises at least one central conduit, the at least one central conduit:

terminating with an orifice on the lower surface and being suitable for conveying incoming air onto the lower surface or conveying air and abrading debris from the lower surface; and being separated from the at least one medial conduit and the at least one peripheral conduit by an unbroken portion of the backing pad.

Example 29: The backing pad according to examples 27 or 28, wherein the attachment elements on the body and/or the lower surface layer enable re-attachment.

Example 30: The backing pad according to any of the examples 27-29, wherein the at least one central conduit, and/or the at least one medial conduit is/are orifices which extend through the body and the lower surface layer of the backing pad.

Example 31: The backing pad according to any of the examples 27-30, wherein the at least one peripheral conduit is a groove on the lower surface having an open end at the outer side wall.

Example 32: The backing pad according to any of the examples 27-30, wherein the at least one peripheral conduit comprises a groove on the lower surface with at least two closed ends and an orifice on the outer side wall.

Example 33: The backing pad according to any of the examples 27-32, wherein the at least one peripheral conduit extends towards the center of the backing pad past at least one of the medial conduits or to the distance of more than 25% of the distance between the starting point of the at least one peripheral conduit at the outer side wall and the center of the backing pad.

Example 34: The backing pad according to any of the examples 27-33, wherein the backing pad has a circular shape.

Example 35: The backing pad according to example 34, wherein the backing pad further comprises a plurality of the medial conduits arranged along at least one concentric circle which is/are concentric with the center of the backing pad.

Example 36: The backing pad according to any of the examples 27-35, wherein at least one of the medial conduits or at least one of the peripheral conduits has an elongated orifice on the lower surface of the backing pad.

Example 37: An abrading system, comprising:

the backing pad according to any of the examples 27-36;

an abrading apparatus capable of being attached to the backing pad, the abrading apparatus adapted to provide suction pressure and comprising at least one conduit capable of being connected to at least one of the medial conduits of the backing pad for sucking air and abrading debris.

Example 38: A method of using the abrading system according to example 37 for removing abrading debris from the lower surface of the backing pad; the method comprising:

suction pressure in the conduits of the abrading apparatus being conveyed into the medial conduits of the backing pad;

incoming air flowing due to the suction pressure onto the lower surface of the backing pad through the central conduit or conduits, if any, through the peripheral conduits, and over the outer side wall of the backing pad; and said incoming air passing over unbroken portions of the backing pad between the lower surface of the backing pad and the abrading article before entering, as pulled in by the suction pressure, into the medial conduits of the backing pad.

Example 39: A method of using the abrading system according to example 37 for removing abrading debris from the lower surface of the backing pad; the method comprising:

suction pressure in the conduits of the abrading apparatus being conveyed into the central conduit or conduits, if any, and the medial conduits of the backing pad;

incoming air flowing due to the suction pressure onto the lower surface of the backing pad through the peripheral conduits, and over the outer side wall of the backing pad; and said incoming air passing over unbroken portions of the backing pad between the lower surface of the backing pad and the abrading article before entering, as pulled in by the suction pressure, into the central conduit or conduits, if any, and the medial conduits of the backing pad.

Example 40: An abrading article suitable for use in an abrading system comprising an abrading apparatus adapted to provide suction pressure, the abrading article comprising:

an upper surface layer with an upper surface and comprising attachment elements suitable for attaching the upper surface layer to a backing pad of the abrading apparatus or to an intermediate pad attachable to the backing pad of the abrading apparatus;

a lower surface layer with a lower surface, the lower surface layer comprising abrasive material such that the lower surface may be used for abrading a work piece;

an outer side wall enclosing the upper surface layer and the lower surface layer; and at least one peripheral conduit suitable for conveying incoming air onto the lower surface, the at least one peripheral conduit extending from the outer side wall to the lower surface.

Example 41: The abrading article according to example 40, wherein the at least one peripheral conduit is a slit or a groove having an open end at the outer side wall.

Example 42: The abrading article according to example 40 or 41, wherein the at least one peripheral conduit is a groove, which groove is formed by the absence of abrading particles in the area constituting the groove on the lower surface of the abrading article, and has an open end at the outer side wall.

Example 43: The abrading article according to any of the examples 40-42, wherein the at least one peripheral conduit extends towards the center of the abrading article to the distance of more than 25% of the distance between the starting point of the peripheral conduit at the outer side wall and the center of the abrading article.

Example 44: The abrading article according to any of the examples 40-43, the abrading article further comprising:

at least one medial conduit suitable for conveying air and abrading debris from the lower surface, the at least one medial conduit extending from the upper surface to the lower surface, and being separated from the at least one peripheral conduit by an unbroken portion of the abrading article.

Example 45: The abrading article according to any of the examples 40-44, the abrading article further comprising at least one central conduit suitable for conveying air onto the lower surface or conveying air and abrading debris from the lower surface, the at least one central conduit extending from the upper surface to the lower surface and being separated from the at least one medial conduit, if any, and the at least one peripheral conduit by an unbroken portion of the abrading article.

Example 46: The abrading article according to examples 44 or 45, wherein the at least one medial conduit and/or the at least one central conduit is/are orifices which extend from the upper surface to the lower surface of the abrading article.

Example 47: The abrading article according to any of the examples 40-46, wherein at least one of the peripheral conduits extends towards the center of the abrading article to the distance of more than 10% of the distance between the starting point of the at least one peripheral conduit at the outer side wall and the center of the abrading article.

Example 48: The abrading article according to any of the examples 40-47, wherein the abrading article has a circular shape.

Example 49: The abrading article according to example 48, wherein is the abrading article further comprises a plurality of the medial conduits arranged along at least one concentric circle which is/are concentric with the center of the abrading article.

Example 50: The abrading article according to any of the examples 44-49, wherein at least one of the medial conduits, if any, has an elongated orifice on the lower surface of the abrading article.

Example 51: The abrading article according to any of the examples 40-50, wherein the lower surface layer comprises an open mesh with small openings, which mesh is coated with abrasive particles.

Example 52: The abrading article according to any or the examples 40-51, wherein the attachment elements on the upper surface layer enable re-attachment.

Example 53: The abrading article according to any of the examples 40-52, wherein the abrading article further comprises an intermediate layer between and attached to the upper surface layer and the lower surface layer.

Example 54: An abrading system, comprising:

the abrading article according to any of the examples 40-53;

a backing pad capable of being attached to the abrading article, the backing pad comprising at least one medial conduit for conveying suction pressure, the at least one medial conduit extending to the interface between the backing pad and the upper surface of the abrading article; and an abrading apparatus, the abrading apparatus adapted to provide the suction pressure, being capable of being attached to the backing pad, and comprising at least one conduit capable of being connected to at least one of the medial conduits of the backing pad for sucking air and abrading debris.

Example 55: A method of using the abrading system according to example 54 for removing abrading debris from the interface between the abrading article and the backing pad, and for removing abrading debris from the lower surface of the abrading article; the method comprising:

suction pressure in conduits of the abrading apparatus being conveyed into the medial conduits of the backing pad;

incoming air flowing due to the suction pressure onto the upper surface and the lower surface of the abrading article through the peripheral conduits and over the outer side wall of the abrading article; and said incoming air passing over unbroken portions of the abrading article before entering into the medial conduits of the backing pad.

Example 56: An abrading system, comprising:

the abrading article according to any of the examples 40-53;

an intermediate pad capable of being attached to the abrading article, the intermediate pad comprising at least one medial conduit for conveying suction pressure, the at least one medial conduit extending to the interface between the intermediate pad and the upper surface of the abrading article;

a backing pad capable of being attached to the intermediate pad and comprising at least one medial conduit for conveying suction pressure, the at least one medial conduit capable of being aligned with at least one of the medial conduits of the intermediate pad; and an abrading apparatus adapted to provide the suction pressure, the abrading apparatus capable of being attached to the backing pad, and comprising at least one conduit capable of being connected to at least one of the medial conduits of the backing pad for sucking air and abrading debris.

Example 57: A method of using the abrading system according to example 56 for removing abrading debris from the interface between the abrading article and the intermediate pad, and for removing abrading debris from the lower surface of the abrading article; the method comprising:

suction pressure in conduits of the abrading apparatus being conveyed into the medial conduits of the backing pad and into the medial conduits of the intermediate pad;

incoming air flowing due to the suction pressure onto the upper surface and the lower surface of the abrading article through the peripheral conduits and over the outer side wall of the abrading article; and said incoming air passing over unbroken portions of the abrading article before entering into the medial conduits of the intermediate pad and the medial conduits of the backing pad.

Example 58: An abrading system, comprising:

the abrading article according any of the examples 44-53;

a backing pad capable of being attached to the abrading article, the backing pad comprising at least one medial conduit for conveying suction pressure, the at least one medial conduit capable of being aligned with at least one of the medial conduits of the abrading article; and an abrading apparatus adapted to provide the suction pressure, the abrading apparatus capable of being attached to the backing pad, and comprising at least one conduit capable of being aligned with at least one of the medial conduits of the backing pad for sucking air and abrading debris.

Example 59: A method of using the abrading system according to example 58 for removing abrading debris from the interface between the abrading article and the backing pad, and for removing abrading debris from the lower surface of the abrading article; the method comprising:

suction pressure in conduits of the abrading apparatus being conveyed into the medial conduits of the backing pad and into the medial conduits of the abrading article;

incoming air flowing due to the suction pressure onto the upper surface and the lower surface of the abrading article through the peripheral conduits and over the outer side wall of the abrading article; and said incoming air passing over unbroken portions of the abrading article before entering into the medial conduits of the abrading article and the medial conduits of the backing pad.

Example 60: A method of using the abrading system according to example 58 for removing abrading debris from the interface between the abrading article and the backing pad, and for removing abrading debris from the lower surface of the abrading article; the method comprising:

suction pressure in conduits of the abrading apparatus being conveyed into the medial conduits and the central conduits of the backing pad and into the medial conduits and the central conduits of the abrading article;

incoming air flowing due to the suction pressure onto the upper surface and the lower surface of the abrading article through the peripheral conduits and over the outer side wall of the abrading article; and said incoming air passing over unbroken portions of the abrading article before entering into the into the medial conduits and the central conduits of the abrading article and into the medial conduits and the central conduits of the backing pad.

Example 61: An abrading system, comprising:

the abrading article according any of the examples 44-53;

an intermediate pad capable of being attached to the abrading article, the intermediate pad comprising at least one medial conduit for conveying suction pressure, the at least one medial conduit capable of being aligned with at least one of the medial conduits of the abrading article;

a backing pad capable of being attached to the intermediate pad and comprising at least one medial conduit capable of being aligned with at least one of the medial conduits of the intermediate pad; and an abrading apparatus adapted to provide suction pressure, the abrading apparatus being capable of being attached to the backing pad, and comprising at least one conduit capable of being connected to at least one of the medial conduits of the backing pad for sucking air and abrading debris.

Example 62: A method of using the abrading system according to example 61 for removing abrading debris from the interface between the abrading article and the intermediate pad, and for removing abrading debris from the lower surface of the abrading article; the method comprising:

suction pressure in conduits of the abrading apparatus being conveyed into the medial conduits of the backing pad, into the medial conduits of the intermediate pad and into the medial conduits of the abrading article;

incoming air flowing due to the suction pressure onto the upper surface and the lower surface of the abrading article through the peripheral conduits and over the outer side wall of the abrading article; and said incoming air passing over unbroken portions of the abrading article before entering into the medial conduits of the backing pad, into the medial conduits of the intermediate pad and into the medial conduits of the abrading article.

Example 63: A method of using the abrading system according to example 61 for removing abrading debris from the interface between the abrading article and the intermediate pad; and for removing abrading debris from the lower surface of the abrading article; the method comprising:

suction pressure in conduits of the abrading apparatus being conveyed into the medial conduits and the central conduits of the backing pad; into the medial conduits and the central conduits of the intermediate pad and into the medial conduits and the central conduits of the abrading article;

incoming air flowing due to the suction pressure onto the upper surface and the lower surface of the abrading article through the peripheral conduits and over the outer side wall of the abrading article; and said incoming air passing over unbroken portions of the abrading article before entering into the into the medial conduits and the central conduits of the abrading article, into the medial conduits and the central conduits of the intermediate pad and into the medial conduits and the central conduits of the backing pad.

In embodiments of the abrading article pad 400 which comprise one or more of the central conduits 410*a*, the central conduit or conduits 410*a* may in some system embodiments be connected to suction pressure and thereby function as air and debris extraction conduits, instead of conveying incoming air onto the upper surface 470 and the lower surface 460 of the abrading article 400. Such embodiments may otherwise adhere to the principles of the solution as described above. Thus, in such embodiments incoming air may originate through the peripheral conduits 410*c* and over the outer side wall 420 of the abrading article 400 and be forced to pass over the upper surface 470 and the lower surface 460 of the abrading article 400 before reaching the nearest suction pressure-connected conduit thereby providing surface flushing which extends substantially into the medial and central regions of the abrading article 400.

The disclosed solutions are not limited to the examples and embodiments explained above and these examples and embodiments should not be construed as limiting. These examples and embodiments may be applied in useful combinations also. The solution is defined in the appended claims supported by this description.

The invention claimed is:

1. A backing pad for use in an abrading apparatus that provides suction pressure, the backing pad having an axis of rotation and comprising: a body having an upper surface and a lower surface, the body comprising attachment elements for attaching the upper surface of the body to the abrading apparatus; the backing pad further comprising a lower surface layer having an upper surface and a lower surface, the upper surface of the lower surface layer being attached to the lower surface of the body and the lower surface of the lower surface layer comprising additional attachment elements for attaching the lower surface of the lower surface layer to a porous abrading article; the backing pad further comprising an outer side wall enclosing the body and the lower surface layer; the backing pad further comprising one or more medial conduits connectable to a source of the suction pressure for conveying air and abrading debris from the lower surface of the lower surface layer, each of the one or more medial conduits having an orifice extending from the lower surface of the lower surface layer to the upper surface of the body and having a central axis offset from the axis of the backing pad; and the backing pad further comprising one or more peripheral conduits for conveying incoming air onto the lower surface of the lower surface layer, wherein each of the one or more peripheral conduits is a groove on the lower surface of the lower surface layer having an open end at the outer side wall, the groove being open towards the abrading article wherein none of the one or more peripheral conduits are connected to the suction pressure, wherein each of the one or more peripheral conduits is separated from each of the one or more medial conduits by an unbroken portion of the backing pad, wherein each of the one or more peripheral conduits is blind so that incoming air is forced to pass through each of the one or more peripheral conduits onto the lower surface of the lower surface layer before reaching a nearest of the one or more medial conduits, wherein each of the one or more medial conduits is connected to the source of the suction pressure during an abrading operation.

2. The backing pad according to claim 1, wherein the backing pad further comprises at least one central conduit, the at least one central conduit: terminating with an orifice on the lower surface of the lower surface layer and being suitable for conveying incoming air onto the lower surface of the lower surface layer or conveying air and abrading debris from the lower surface of the lower surface layer into the central conduit; and being separated from each of the at least one medial conduits and each of the at least one peripheral conduits by an unbroken portion of the backing pad.

3. The backing pad according to claim 1, wherein either or both of the attachment elements on the body and the additional attachment elements of the lower surface layer enable re-attachment.

4. The backing pad according to claim 1, wherein the backing pad further comprises at least one central conduit, and wherein the at least one central conduit is an orifice which extends through the body and the lower surface of the lower surface layer of the backing pad.

5. The backing pad according to claim 1, wherein each of the at least one peripheral conduits comprises a groove on the lower surface of the lower surface layer with at least two closed ends and an orifice on the outer side wall.

6. The backing pad according to claim 1, wherein each of the at least one peripheral conduits extends towards a center of the backing pad past at least one of the medial conduits or to a distance of more than 25% of the distance between a starting point of said at least one peripheral conduit at the outer side wall and the center of the backing pad.

7. The backing pad according to claim 1, wherein the backing pad has a circular shape.

8. The backing pad according to claim 7, wherein the backing pad further comprises a plurality of the medial conduits arranged along at least one concentric circle wherein each of the at least one concentric circles is concentric with a center of the backing pad.

9. The backing pad according to claim 1, wherein at least one of the medial conduits has an elongated orifice on the lower surface of the lower surface layer of the backing pad.

* * * * *